US007874194B2

(12) United States Patent
Shimota et al.

(10) Patent No.: US 7,874,194 B2
(45) Date of Patent: Jan. 25, 2011

(54) DIE HOLDER TECHNOLOGY FOR METAL-FABRICATING PRESS

(75) Inventors: Jon M. Shimota, Stillwater, MN (US); Brian J. Lee, Elk River, MN (US)

(73) Assignee: Wilson Tool International Inc., White Bear, MN (US)

( * ) Notice: Subject to any disclaimer, the term of this patent is extended or adjusted under 35 U.S.C. 154(b) by 979 days.

(21) Appl. No.: 11/684,436

(22) Filed: Mar. 9, 2007

(65) Prior Publication Data

US 2008/0216551 A1 Sep. 11, 2008

(51) Int. Cl.
*B23Q 3/00* (2006.01)
*B23Q 3/155* (2006.01)
*B26D 7/26* (2006.01)

(52) U.S. Cl. ..... 72/481.1; 72/442; 72/462; 72/482.5; 72/482.91; 72/482.93; 29/50; 483/31; 83/552; 83/563; 83/698.11; 83/699.51

(58) Field of Classification Search ..... 72/441, 72/442, 446, 448, 462, 481.1, 492.92, 492.93, 72/42.92, 482.93; 83/552, 559, 563, 564; 483/28, 29, 31; 29/568, 50
See application file for complete search history.

(56) References Cited

U.S. PATENT DOCUMENTS

| | | | |
|---|---|---|---|
| 1,462,556 | A | 7/1923 | Kropp |
| 2,364,401 | A | 12/1944 | Stellin |
| 2,378,806 | A | 6/1945 | Stellin |
| 2,380,343 | A | 7/1945 | Stellin |
| 3,282,143 | A | 11/1966 | Wierscheim |
| 3,495,495 | A | 2/1970 | Berry |
| 3,535,967 | A | 10/1970 | Whistler, Sr. |
| 3,951,026 | A | 4/1976 | Beauplat |
| 4,012,975 | A | 3/1977 | LaLone |
| 4,141,264 | A | 2/1979 | Weisbeck |
| 4,165,669 | A | 8/1979 | Brown |
| 4,240,314 | A | 12/1980 | Teeslink |
| 4,486,941 | A | 12/1984 | Scott |

(Continued)

FOREIGN PATENT DOCUMENTS

EP 0 311 857 A1 4/1989

(Continued)

OTHER PUBLICATIONS

Communication Relating to the Results of the Partial International Search for PCT Application No. PCT/US2008/054430 dated Jul. 7, 2008, 6 pages.

(Continued)

*Primary Examiner*—David B Jones
(74) *Attorney, Agent, or Firm*—Fredrikson & Byron, P.A.

(57) ABSTRACT

The invention involves a die holder for a press, such as a metal-fabricating press. The die holder can be configured to receive a die, and can include a clamp portion and a wall portion. Preferably, the clamp and wall portions can be positioned in an open configuration or a closed configuration, and the die holder can be adjusted from an unclamped configuration to a clamped configuration. The die holder may have a die-release mechanism useful for overcoming stiction and facilitating removal of the die from the die holder.

57 Claims, 40 Drawing Sheets

U.S. PATENT DOCUMENTS

| | | | | | |
|---|---|---|---|---|---|
| 4,552,050 | A | | 11/1985 | Grefe | |
| 4,570,327 | A | | 2/1986 | Klingel | |
| 4,612,796 | A | | 9/1986 | Smyth, Jr. | |
| 4,627,321 | A | | 12/1986 | Moore | |
| 4,643,460 | A | | 2/1987 | Lieberg | |
| 4,718,161 | A | | 1/1988 | Pfister | |
| 4,736,612 | A | | 4/1988 | Russell | |
| 4,756,630 | A | | 7/1988 | Teeslink | |
| 4,779,329 | A | | 10/1988 | Nordquist | |
| 4,790,173 | A | | 12/1988 | Boutcher, Jr. | |
| 4,898,015 | A | | 2/1990 | Houston | |
| 4,910,860 | A | | 3/1990 | Winkler | |
| 5,042,352 | A | | 8/1991 | Lux | |
| 5,048,385 | A | | 9/1991 | Eckert | |
| 5,062,337 | A | | 11/1991 | Johnson | |
| 5,081,891 | A | | 1/1992 | Johnson | |
| 5,295,938 | A | | 3/1994 | Jilsen | |
| 5,346,454 | A | * | 9/1994 | Hayashi | 72/446 |
| 5,451,195 | A | * | 9/1995 | Fujiwara et al. | 483/29 |
| 5,545,116 | A | * | 8/1996 | Seto | 83/552 |
| 5,635,223 | A | | 6/1997 | Korsch | |
| 5,843,488 | A | | 12/1998 | Korsch | |
| 5,901,628 | A | | 5/1999 | Sakamoto | |
| 5,906,539 | A | | 5/1999 | Tabel | |
| 5,988,694 | A | | 11/1999 | Brushaber | |
| 6,044,742 | A | | 4/2000 | Sakamoto | |
| 6,047,621 | A | | 4/2000 | Dries | |
| 6,074,330 | A | | 6/2000 | Ostini | |
| 6,260,393 | B1 | | 7/2001 | Engel | |
| 6,279,445 | B1 | | 8/2001 | Rosene | |
| 6,463,839 | B2 | | 10/2002 | Ohtsuka | |
| 6,499,330 | B1 | | 12/2002 | Pelech, Jr. | |
| 6,826,946 | B2 | | 12/2004 | Muller | |
| 2001/0054344 | A1 | | 12/2001 | Sakamoto | |
| 2004/0237623 | A1 | | 12/2004 | Russell | |
| 2006/0107727 | A1 | | 5/2006 | Pelech | |
| 2008/0295567 | A1 | | 12/2008 | Thielges | |

FOREIGN PATENT DOCUMENTS

| | | | |
|---|---|---|---|
| EP | 1 046 438 | | 10/2000 |
| EP | 1 447 154 | A2 | 8/2004 |
| FR | 2 580 988 | | 10/1986 |
| GB | 2 030 497 | A | 4/1980 |
| JP | 2002 219517 | A | 8/2002 |
| WO | 99/01240 | A1 | 1/1999 |
| WO | 01/08828 | A1 | 2/2001 |

OTHER PUBLICATIONS

Carrlane, Cam Edge Clamps, Catalog Index Pg., www.carrlane.com/catalog/index.cfm/26605071F0B021118070C1C510D020-609090C0015480013180B041D1E173C1B085352; Jun. 26, 2006.

International Search Report and Written Opinion of the International Searching Authority for PCT Application No. PCT/US2008/054430 dated Nov. 4, 2008, 17 pages.

English-language abstract—French Patent Publication FR 2 580 988 (Pfister).

* cited by examiner 160
150
100
140
70
310
290
220
130
280
260
180
OB
330
322
320
210
330
300
170
270
290
310
260

150
100
140
160
390
130
280
220
70
OB
210
170
380
270
360
350

DIE HOLDER TECHNOLOGY FOR METAL-FABRICATING PRESS

FIELD OF THE INVENTION

The present invention is in the field of die holders for machine tools. More particularly, this invention relates to die holders for metal-fabricating presses.

BACKGROUND OF THE INVENTION

Metal-fabricating presses, such as turret presses, single-station presses, etc., are used to fabricate sheet metal and other sheet-like workpieces. Commonly, each press includes an upper table and a lower table, and at least one die holder adapted for holding a die securely between the upper and lower tables. In many cases, the die holder is adapted to tightly hold the die with a plurality of set screws. In order to change out a die, the set screws must be loosened before the old die can be removed. Then, the new die can be loaded into the die holder (e.g., after moving the new die into the space between the upper and lower tables). The upper and lower tables of many presses are relatively close together. Thus, replacing dies can be a difficult and time consuming process. In addition, after a pressing operation, the die can be hard to remove from the die holder due to stiction. Stiction occurs when the die becomes stubbornly stuck in the die holder (e.g., due to a close fit between the die and the die holder, and any lubrication present). Stiction causes additional difficulty because the die must be forced from the die holder.

SUMMARY OF THE INVENTION

In certain embodiments, the invention provides a die holder for a metal-fabricating press. The die holder can define an interior recess configured to receive a die, and the die holder can include a clamp portion (which in some embodiments can be concave) and a wall portion (which also can be concave in some embodiments). If desired, the wall portion can be formed of a pre-hard material, such as hardened tool steel. The clamp and wall portions can be adapted to be positioned in an open configuration or a closed configuration, with the clamp and wall portions together surrounding the interior recess when in the closed configuration. Further, the die holder can be adjusted from an unclamped configuration to a clamped configuration by performing a clamping operation, and the die holder can be adjusted from the clamped configuration to the unclamped configuration by performing an unclamping operation. When the die is received in the interior recess and the die holder is in the clamped configuration, the die is clamped securely by the die holder.

In some embodiments, the die holder has an open configuration that involves a side of the die holder being open. Such die holders are useful, for example, for mounting and dismounting dies in a confined space, such as between the upper and lower tables of a press. Such die holders can be configured to allow a die to be easily inserted in, or removed from, the die holder from the perimeter of the press. This may avoid the need of having to lift a die upwardly during removal from the die holder, which may be difficult due to the limited space between the tables of the press.

In certain embodiments, the invention provides a die holder for a metal-fabricating press. The die holder defines an interior recess configured to receive a die. The die holder includes a clamp portion and a wall portion. In the present embodiments, the clamp and wall portions are adapted to be positioned in an open configuration or a closed configuration.

Preferably, the clamp and wall portions together surround the interior recess when in the closed configuration. The die holder can be adjusted from an unclamped configuration to a clamped configuration by performing a clamping operation, and the die holder can be adjusted from the clamped configuration to the unclamped configuration by performing an unclamping operation. Preferably, when the die is received in the interior recess and the die holder is in the clamped configuration, the die is clamped securely by the die holder. In the present embodiments, the die holder is provided with a single-motion actuator, such that the die holder is adapted to clamp in response to a single motion of the actuator.

Some embodiments of the invention provide a die holder for a metal-fabricating press. The die holder defines an interior recess configured to receive a die. The die holder includes a clamp portion and a wall portion. Preferably, the clamp and wall portions are adapted to be positioned in an open configuration or a closed configuration. In the present embodiments, the clamp and wall portions together surround the interior recess when in the closed configuration. The die holder can be adjusted from an unclamped configuration to a clamped configuration by performing a clamping operation, and the die holder can be adjusted from the clamped configuration to the unclamped configuration by performing an unclamping operation. Preferably, when the die is received in the interior recess and the die holder is in the clamped configuration, the die is clamped securely by the die holder. In the present embodiments, when the clamp and wall portions are positioned in the open configuration, the die can be mounted in the die holder by moving the die sideways through an open side of the die holder, after which the clamp and wall portions can be positioned in the closed configuration and then the clamping operation can be performed to securely clamp the die holder on the die. In certain embodiments of this nature, the die holder is provided with an actuator comprising a pivotable body that moves pivotally during the clamping and unclamping operations. The actuator in such embodiments can optionally be a tool-free actuator.

Certain embodiments provide a metal-fabricating press and a die holder in combination. In some of these embodiments, the metal-fabricating press has upper and lower tables separated by a gap. The gap is adapted to receive a sheet-like workpiece. In the present embodiments, the die holder is removably mounted on the lower table. The die holder defines an interior recess configured to receive a die. The die holder includes a clamp portion and a wall portion. Preferably, the clamp and wall portions are adapted to be positioned in an open configuration or a closed configuration. In the present embodiments, the clamp and wall portions together surround the interior recess when in the closed configuration. The die holder can be adjusted from an unclamped configuration to a clamped configuration by performing a clamping operation, and the die holder can be adjusted from the clamped configuration to the unclamped configuration by performing an unclamping operation. Preferably, when the die is received in the interior recess and the die holder is in the clamped configuration, the die is clamped securely by the die holder. In the present embodiments, when the clamp and wall portions are in the open configuration, the die can be moved into the gap and mounted in the die holder by moving the die sideways through an open side of the die holder, after which the clamp and wall portions can be positioned in the closed configuration and then the clamping operation can be performed (e.g., to securely clamp the die holder on the die). In the present embodiments, the die holder is provided with an actuator comprising a moveable body that pivots about at least one hinge during the clamping and unclamping operations.

Optionally, the actuator in the present embodiments can be a tool-free actuator, a single-motion actuator, or both.

In some embodiments, the invention provides a tool-free die holder for a metal-fabricating press. The die holder defines an interior recess configured to receive a die. The die holder includes a clamp portion and a wall portion. Preferably, the clamp and wall portions are adapted to be positioned in an open configuration or a closed configuration. In the present embodiments, the clamp and wall portions together surround the interior recess when in the closed configuration. The die holder can be adjusted from an unclamped configuration to a clamped configuration by performing a clamping operation, and the die holder can be adjusted from the clamped configuration to the unclamped configuration by performing an unclamping operation. Preferably, when the die is received in the interior recess and the die holder is in the clamped configuration, the die is clamped securely by the die holder. In the present embodiments, the die holder is provided with a tool-free actuator, such that both the clamping and unclamping operations are tool-free operations.

In some embodiments, the invention provides a die holder having a die-release mechanism. The die-release mechanism can include a body with a contact portion adapted to contact a portion of the die to apply a separation force on the die to urge the die away from at least a portion of the die holder. Such a die-release mechanism may, for example, be useful for overcoming stiction and facilitating removal of the die from the die holder.

In certain embodiments, the invention provides a die holder for a metal-fabricating press. The die holder defines an interior recess configured to receive a die. In the present embodiments, the die holder has a die-release mechanism, and the die-release mechanism is adapted for selective actuation, such that when the die is received in the interior recess the die-release mechanism can be actuated at a desired time to apply a separation force on the die. This separation force urges the die away from at least a portion of the die holder.

Some embodiments provide a die holder for a metal-fabricating press. The die holder defines an interior recess configured to receive a die. The die holder includes a clamp portion and a wall portion. Preferably, the clamp and wall portions are adapted to be positioned in an open configuration or a closed configuration. In the present embodiments, the clamp and wall portions together surround the interior recess when in the closed configuration. In the present embodiments, when the clamp and wall portions are in the open configuration, the die can be mounted in the die holder by moving the die sideways through an open side of the die holder. In the present embodiments, the die holder has a die-release mechanism, and the die-release mechanism is adapted for applying a separation force to the die when the die is received in the interior recess. In the present embodiments, the separation force is directed such that when the clamp and wall portions are in the open configuration the separation force urges the die toward the open side of the die holder.

In some embodiments, the invention provides a combination involving a die holder and a metal-fabricating press, a combination of a die and die holder, a combination of a die, a die holder, and a press, or methods of using such a die holder, metal-fabricating press, and/or die.

DETAILED DESCRIPTION OF PREFERRED EMBODIMENTS

Figure 1:
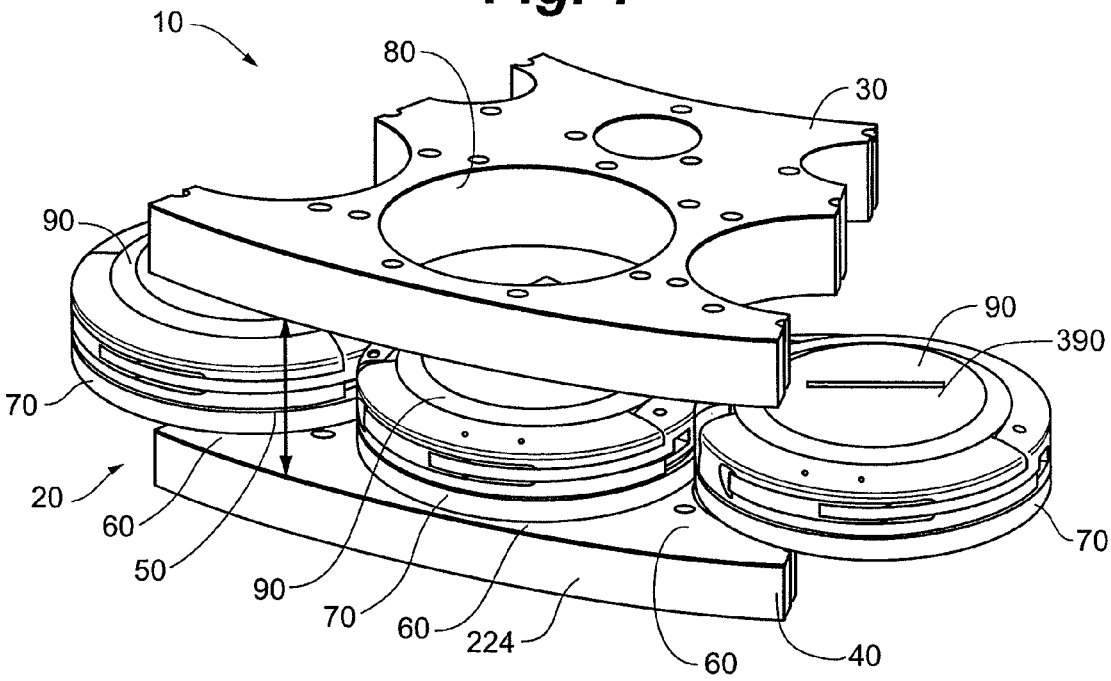
FIG. 1 is a schematic, broken-away perspective view of a metal-fabricating press in accordance with an embodiment of the invention.

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the given examples have many useful alternatives, which fall within the scope of the invention.

Some embodiments of the invention provide a die holder for a metal-fabricating press. In some cases, the press has an upper table and a lower table. A gap between the upper and lower tables is adapted to receive sheet metal or another sheet-like workpiece. In some cases, the upper table may be omitted. The lower table preferably is adapted to have mounted thereon at least one die holder (a wall portion 140 of the die holder may be mounted fixedly on the table, and a clamp portion 130 of the die holder may, in some cases, be adapted for being removably attached to the wall portion). The lower table commonly has a horizontal surface on which the die holder can be mounted and/or defining a mount opening in which the die holder can be mounted. The mount opening in such a press can optionally have a generally circular configuration. In other cases, the mount opening is adapted to receive a polygonal (e.g., generally square) die holder.

One type of metal-fabricating press is shown in FIG. 1. Here, the press 10 is a turret press, although the metal-fabricating press 10 can be a single-station press or any other metal-fabricating press. The metal-fabricating press 10 can include any machine useful for the fabrication of sheet-like workpieces, such as sheet metal or other metal parts. The fabrication process itself can include any work step, such as punching holes, creating bends, etc.

Figure 30:
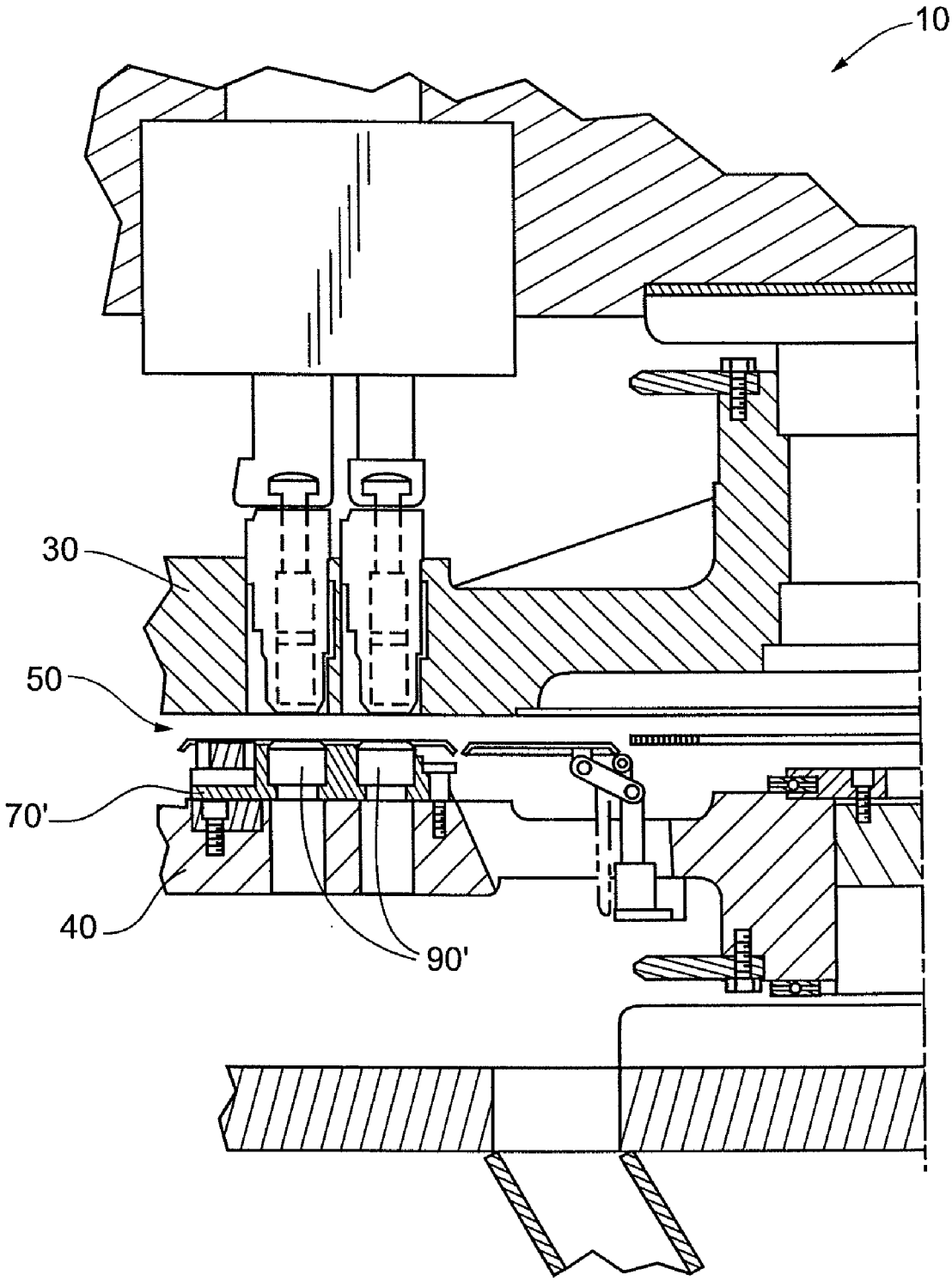
FIG. 30 is a broken-away, schematic cross-sectional side view of a metal-fabricating press involved in certain embodiments of the invention.
Figure 31:
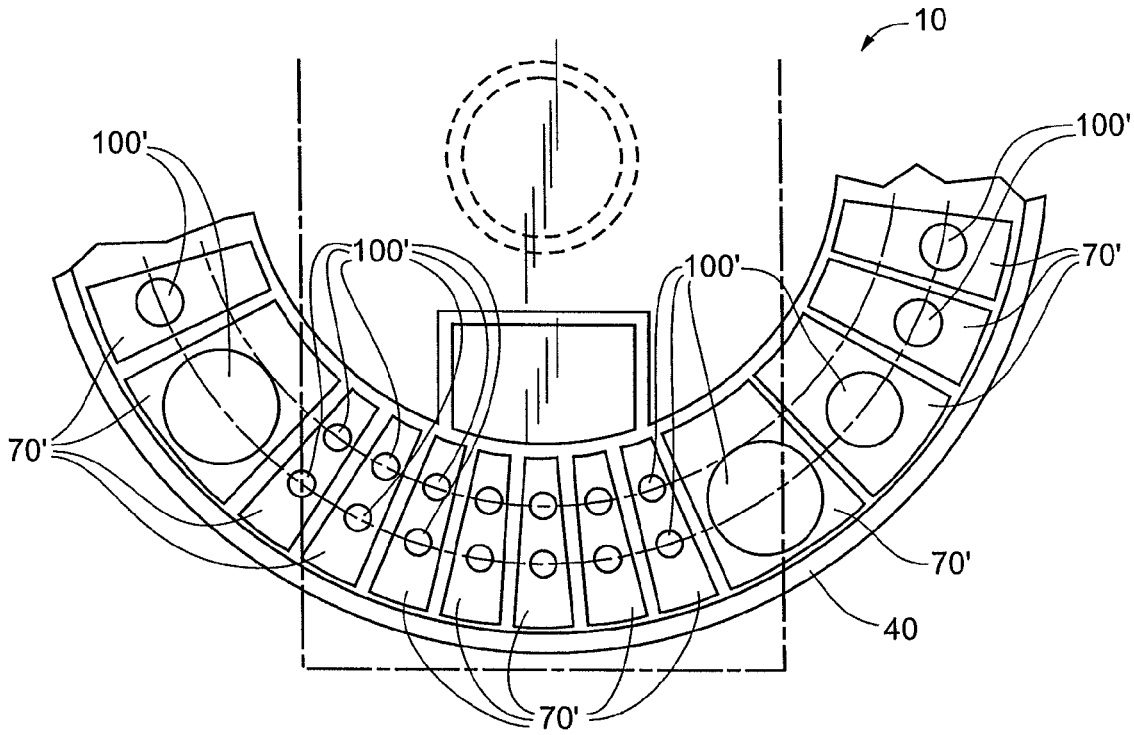
FIG. 31 is a schematic broken-away top view of a turret press involved in certain embodiments of the invention.
Figure 32:
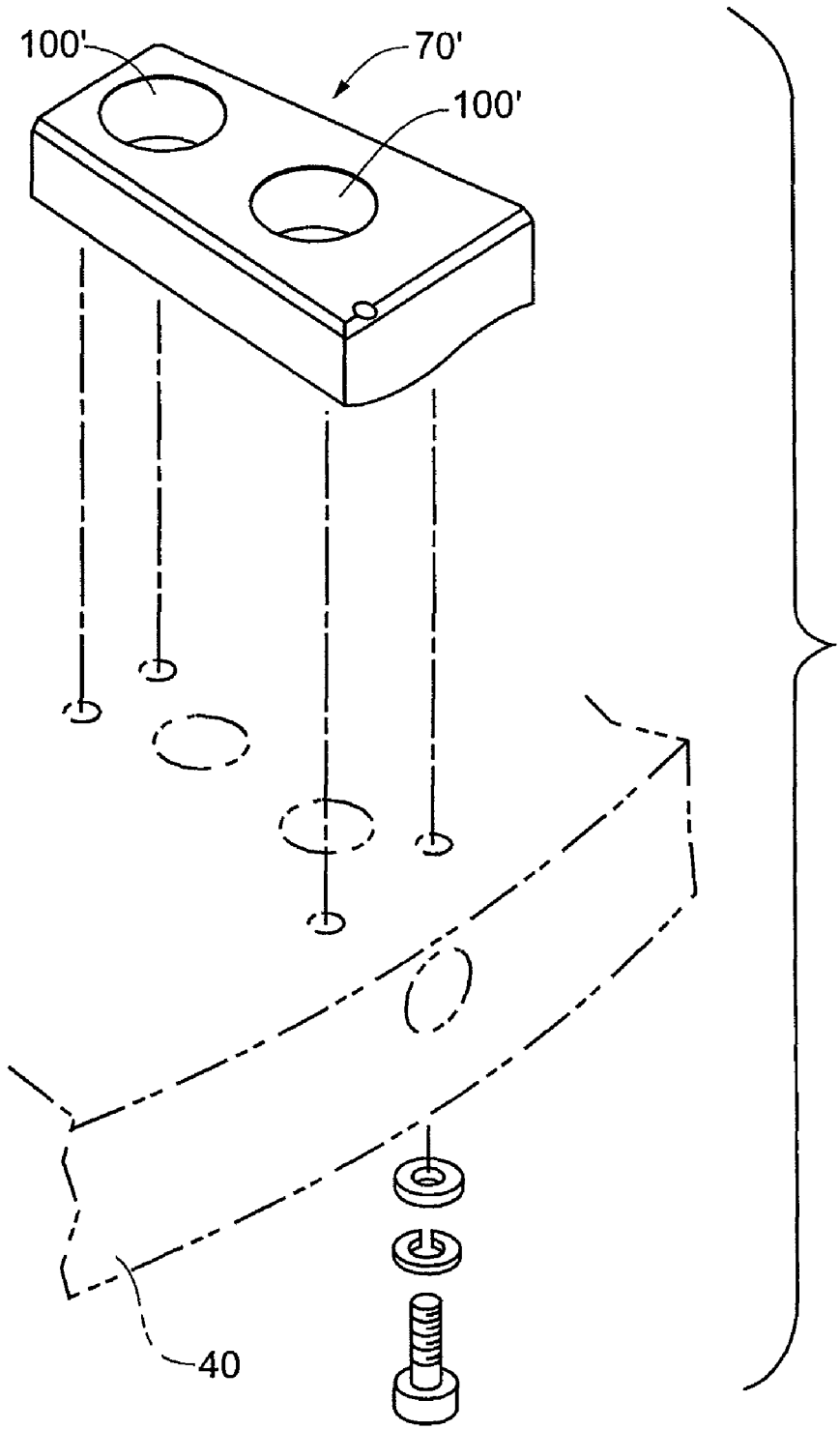
FIG. 32 is a schematic broken-away perspective view of one exemplary manner in which a die holder can be mounted on a table of a metal-fabricating press.
Figure 33:
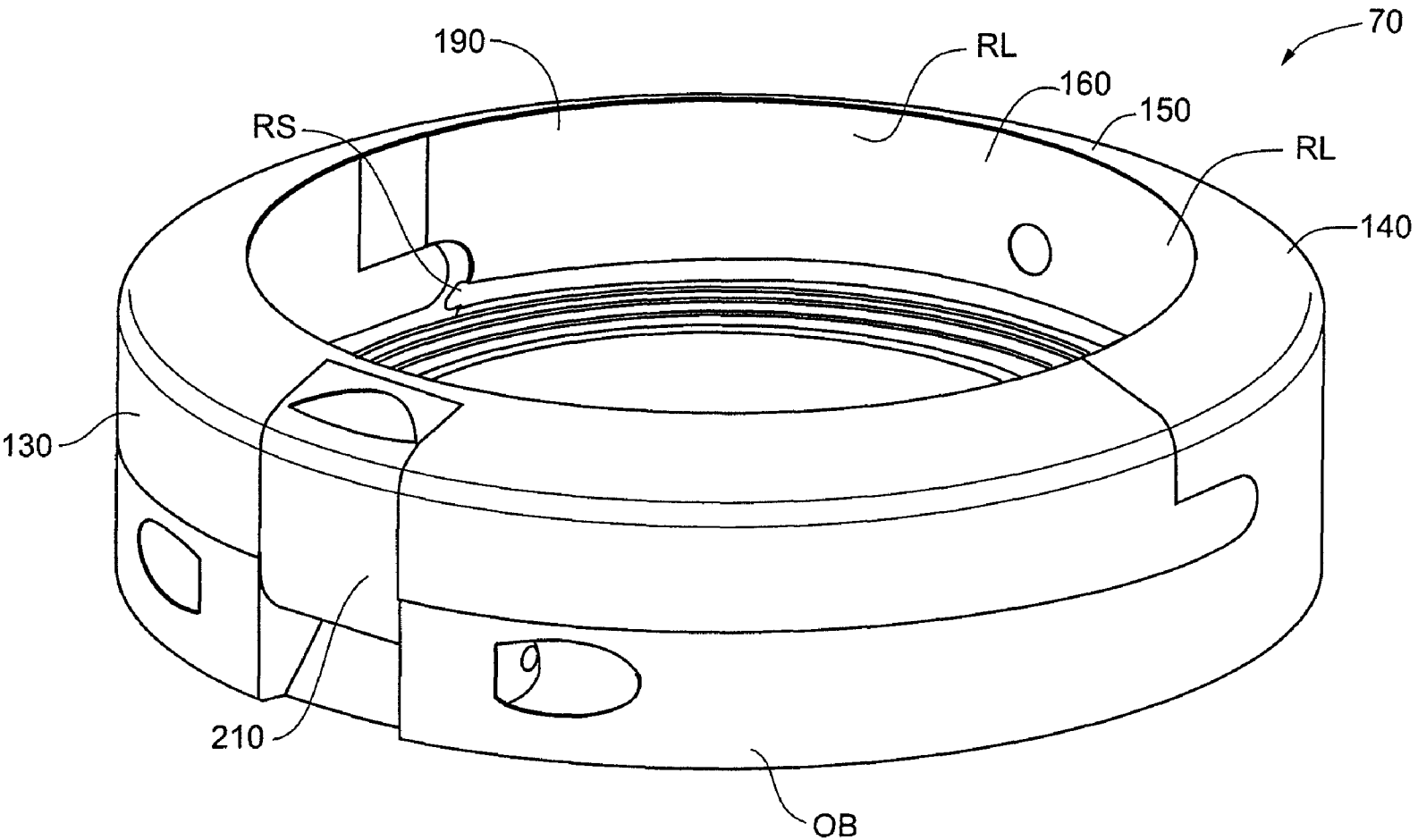
FIG. 33 is a perspective view of a die holder in a closed and clamped configuration in accordance with certain embodiments of the invention.
Figure 34:
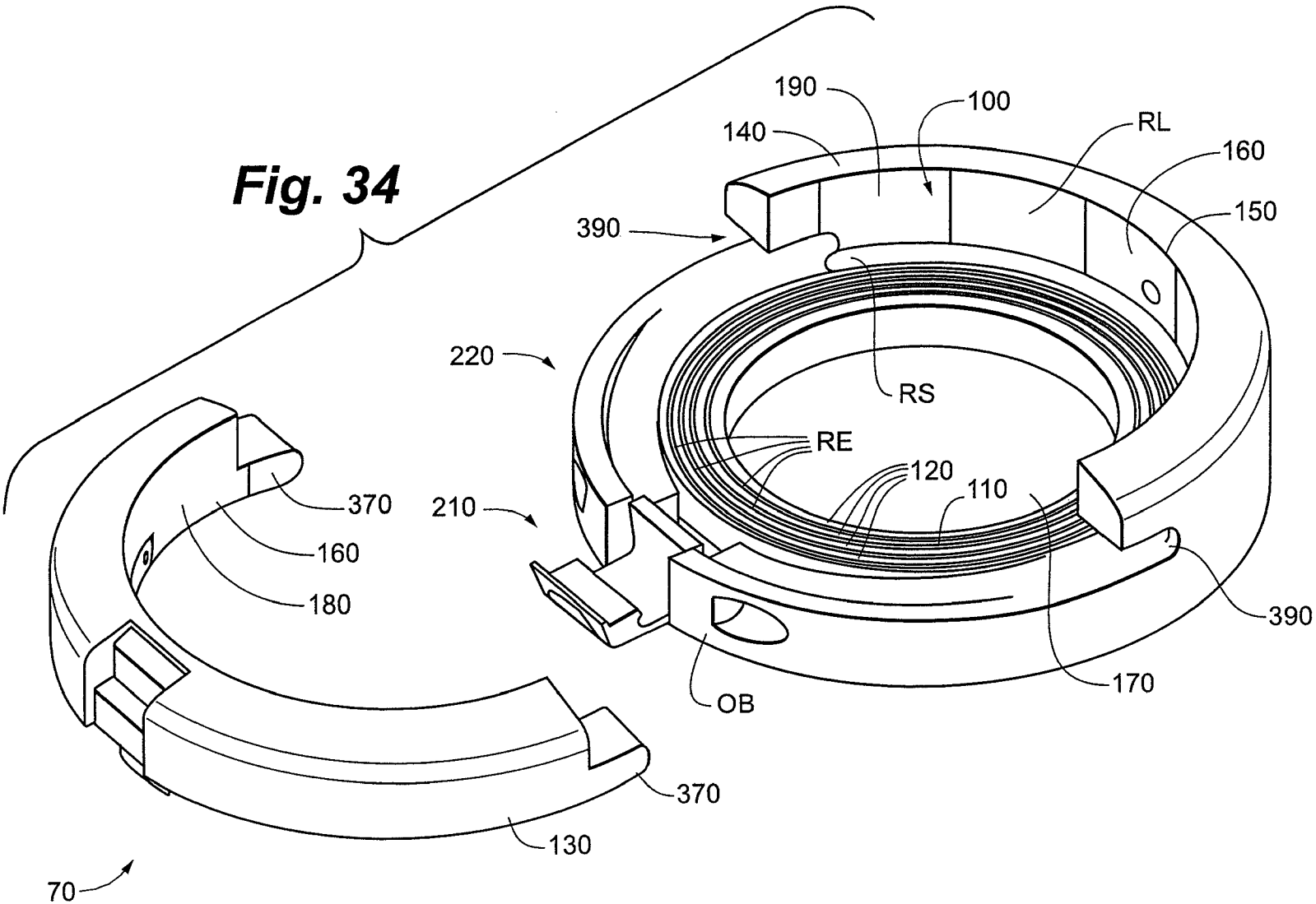
FIG. 34 is a perspective view of the die holder of FIG. 33 in an open configuration.
Figure 35:
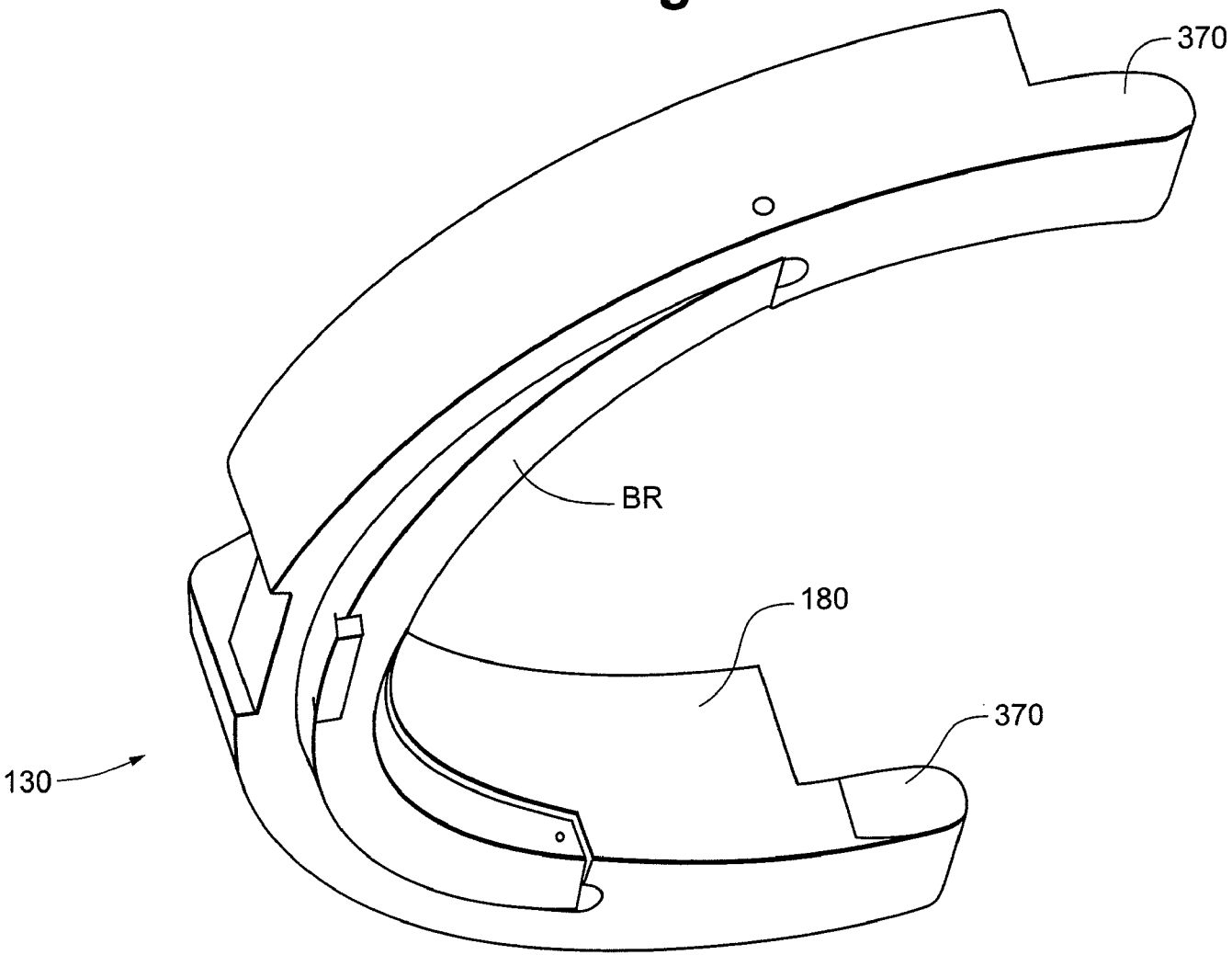
FIG. 35 is a perspective view of a clamp portion of the die holder of FIG. 34.
Figure 36:
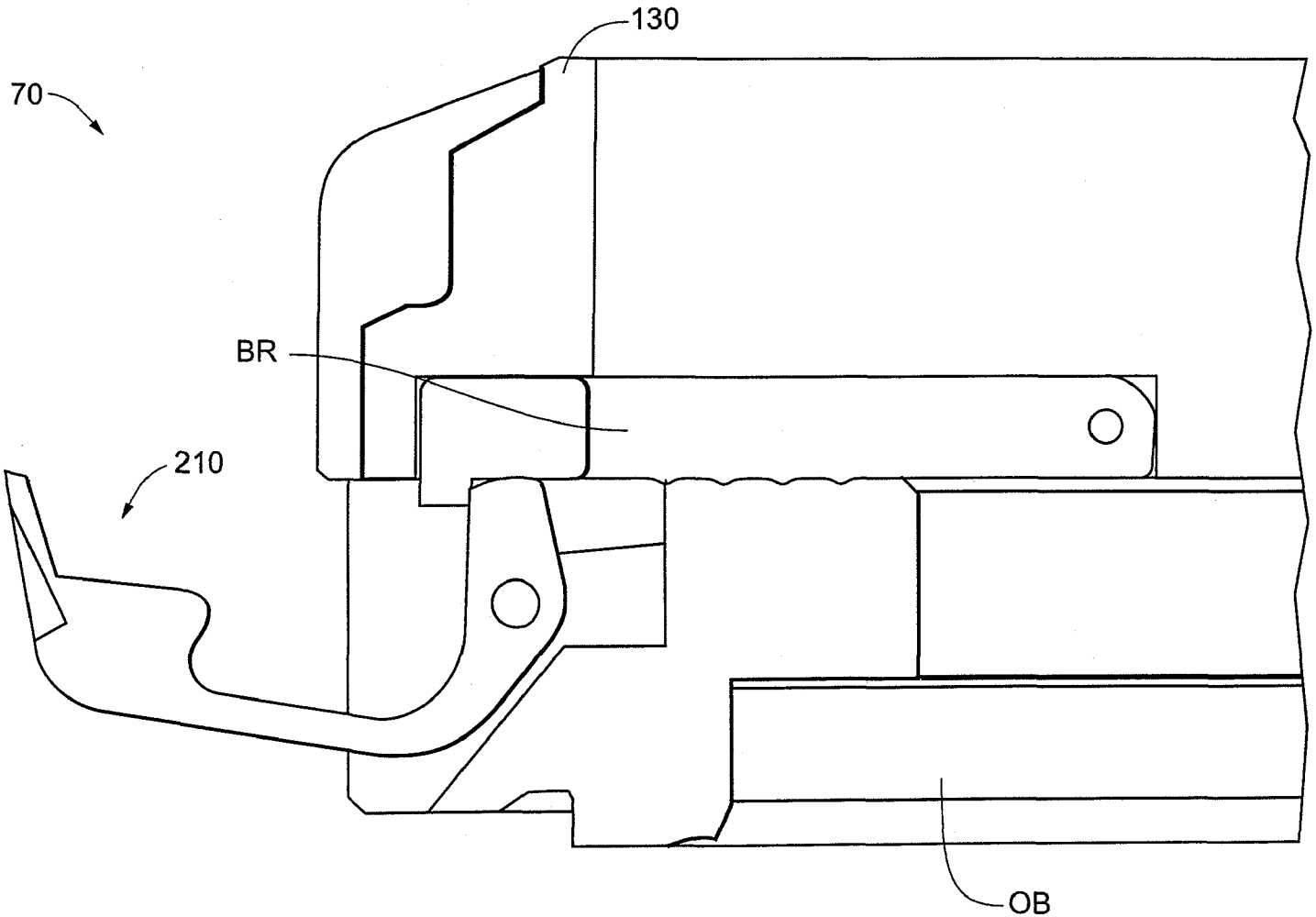
FIG. 36 is a broken-away schematic cross-sectional side view of the die holder of FIG. 33.

In some embodiments, the metal-fabricating press 10 includes (e.g., is) a turret press 20. In such embodiments, the turret press 20 can include an upper table (e.g., an upper turret) 30 and a lower table (e.g., a lower turret) 40. The upper table 30 and lower table 40 can be separated by a turret gap 50 adapted to receive sheet-like workpieces. The turret press 20 can include a plurality of stations (reference is made to FIG. 31), at least one of which is adapted to receive a die holder 70. In some embodiments, the die holder 70 is adapted for being removably mounted in an opening 80 defined by a table of the metal-fabricating press 10. (The embodiment shown in FIG. 1 has such openings in the lower table 40, but they are not visible because die holders 70 have been mounted therein). In other cases (see FIG. 32), the die holder is not potted in an opening defined by the lower table, but is bolted or otherwise anchored removably to the table. A wall portion 140 of the die holder 70 can optionally be mounted in a stationary position on the table. Metal sheets and/or other workpieces (including non-metal sheets and other non-metal workpieces requiring bends, holes, forms, or other fabrication) can be placed between the upper and lower turrets, and a punch or other tool mounted on the upper turret (see FIG. 30) may be caused to act against the workpiece, forcing the workpiece against the die for fabrication. The lower and upper tables may be adapted to rotate together to allow any desired tool set to be moved into position to act on the workpiece. In such presses, the dies are changed periodically to accommodate different fabrication operations, and to replace worn dies.

For embodiments involving a turret press (or other presses with upper and lower tables separated by a gap), to mount a die 90 within the die holder 70, the die can be moved into the gap and mounted in the die holder.

In some embodiments, the die can be moved into the die holder through an open side of the die holder. The open side (which preferably can be closed once the die is mounted on the die holder) may optionally be bounded underneath by an opening base OB of the die holder. The opening base OB, when provided, desirably has a smaller height than the wall portion 140 of the die holder. Preferably, the opening base OB forms part of the die holder's shelf 110 and defines a portion of the support surface 120 that is adapted to support the bottom of a die. When the clamp portion 130 of the die holder is in its closed configuration, the clamp portion can optionally be carried against (e.g., positioned on top of) at least part of the opening base OB.

Figure 2:
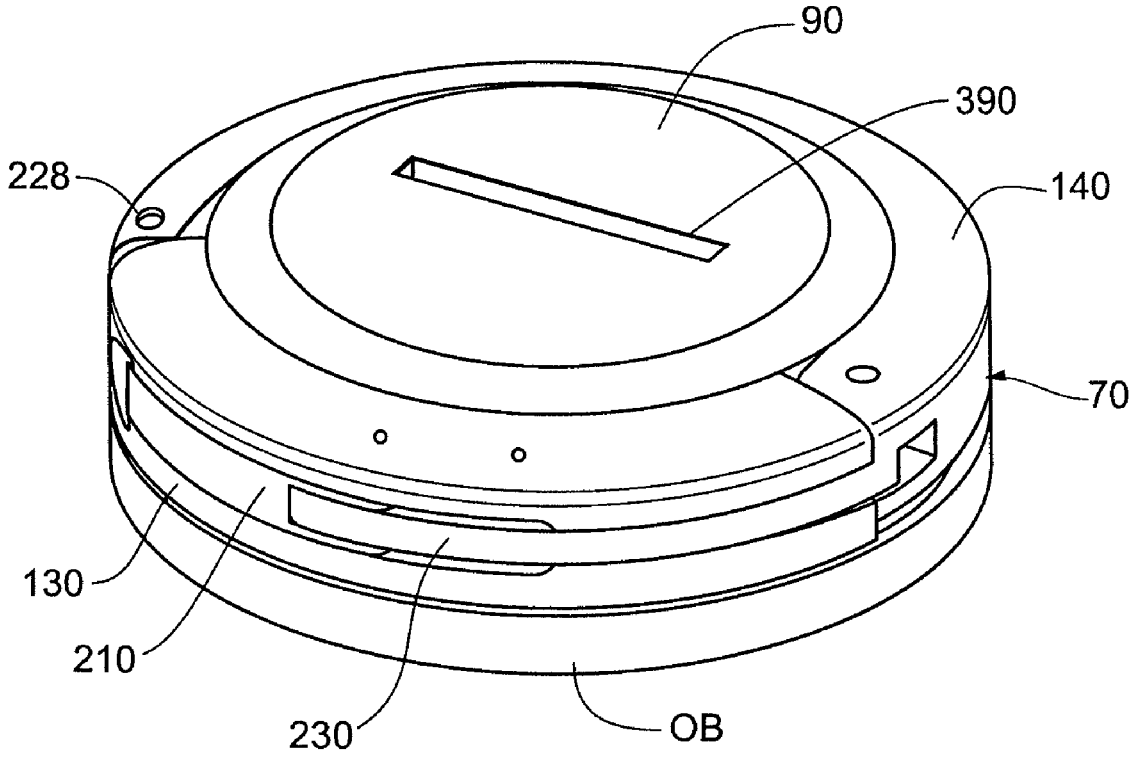
FIG. 2 is a perspective view of a die and a die holder in accordance with an embodiment of the invention.
Figure 39:
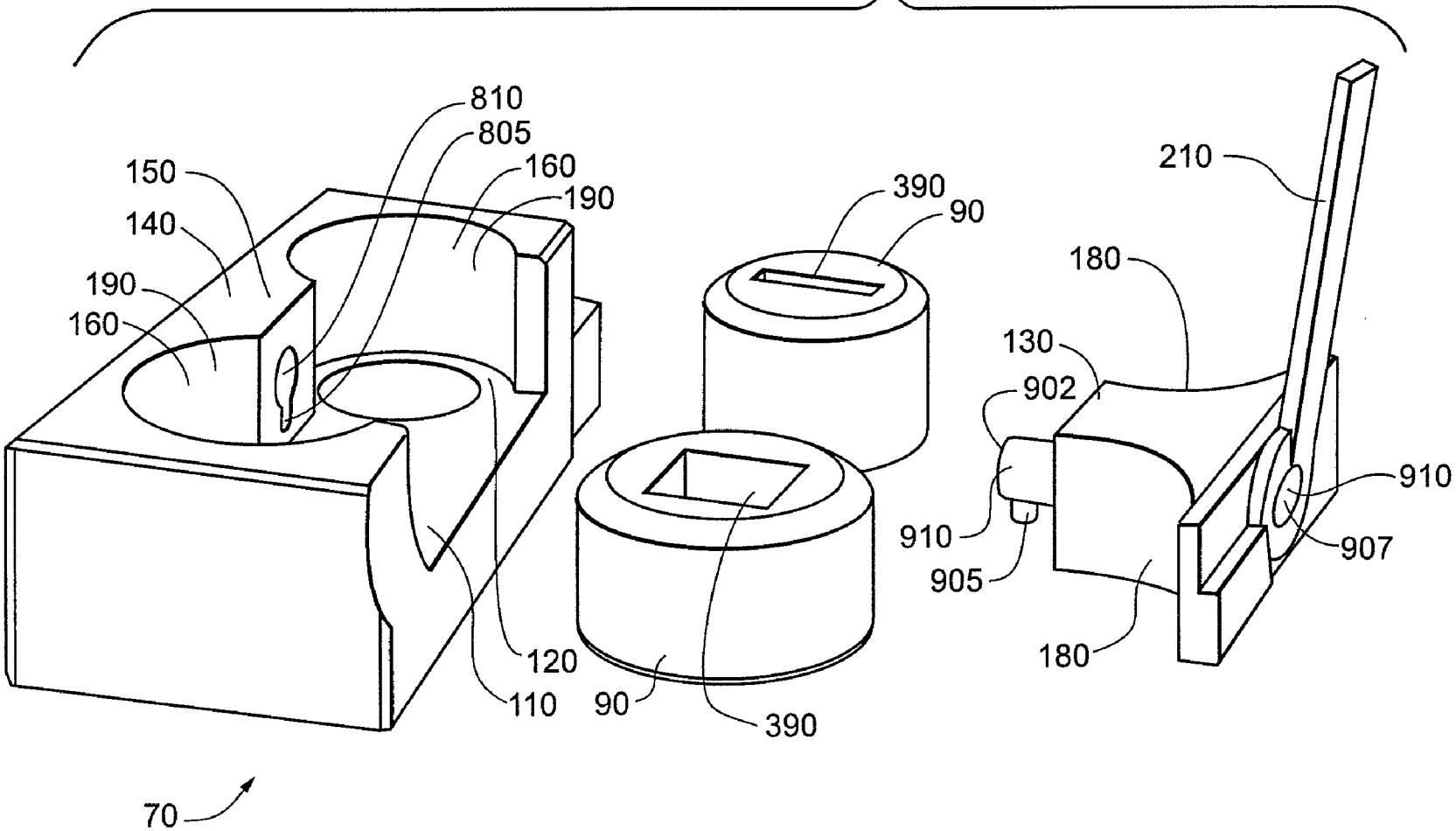
FIG. 39 is a perspective view of a multiple-track die holder and two dies in accordance with certain embodiments of the invention.
Figure 40:
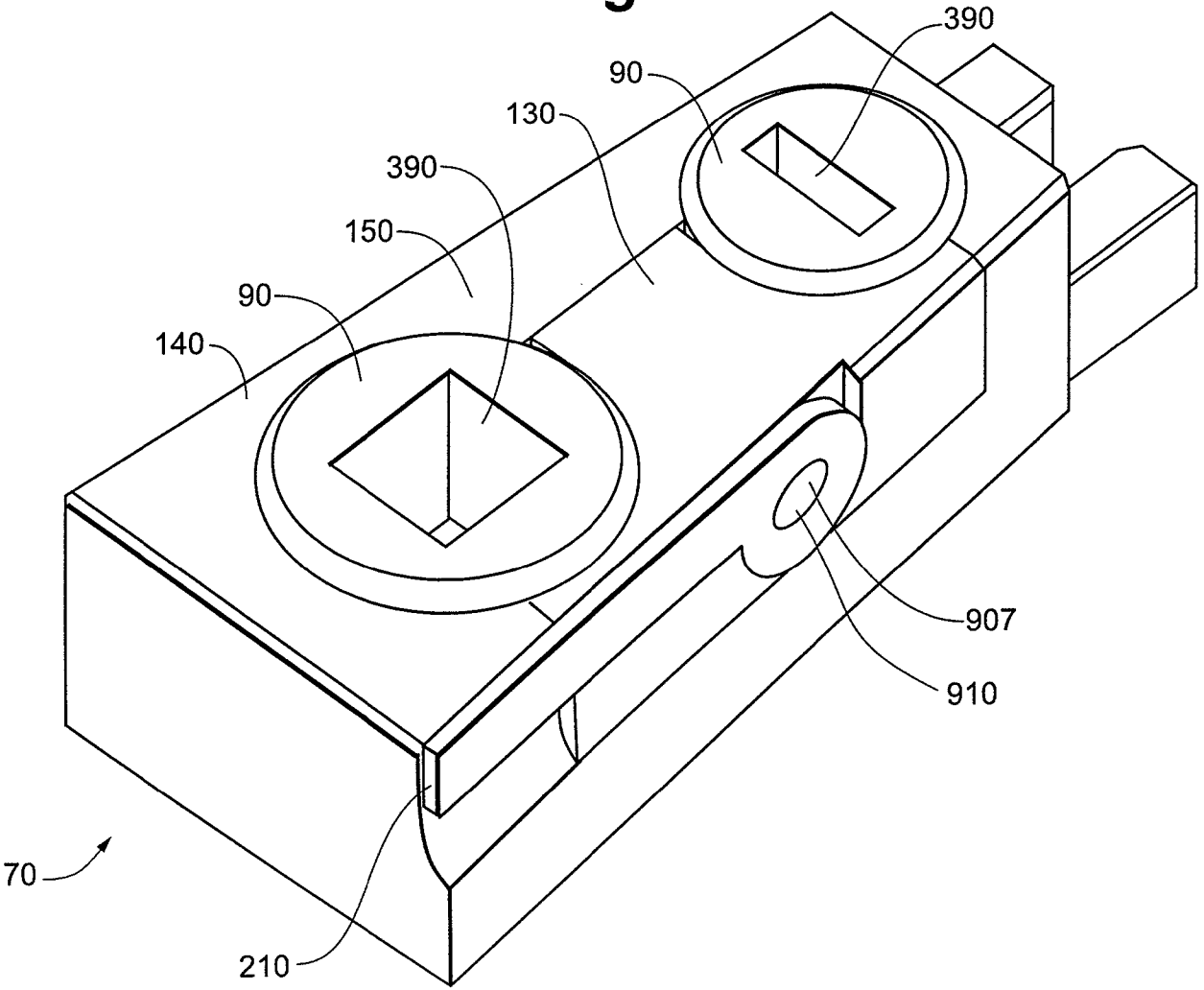
FIG. 40 is a perspective view of the die holder and dies of FIG. 39, with the die holder clamped on the dies.

One exemplary embodiment of a die 90 mounted in a die holder 70 is shown in FIG. 2. Here, the clamping operation results in the die holder clamping a single die, although other embodiments involve the clamping operation causing the die holder to simultaneously clamp on at least two dies. FIGS. 39 and 40, for example, depict a multiple-track die holder embodiment wherein the clamping operation causes the die holder to simultaneously clamp on two dies. More will be said later of the embodiments in FIGS. 39 and 40.

In some cases, the die holder is used on a single-station metal-fabricating press. In embodiments of this nature, the press typically does not involve turrets, although the press may still have upper and lower tables (or at least a lower table), as is well known in the present art.

Figure 37:
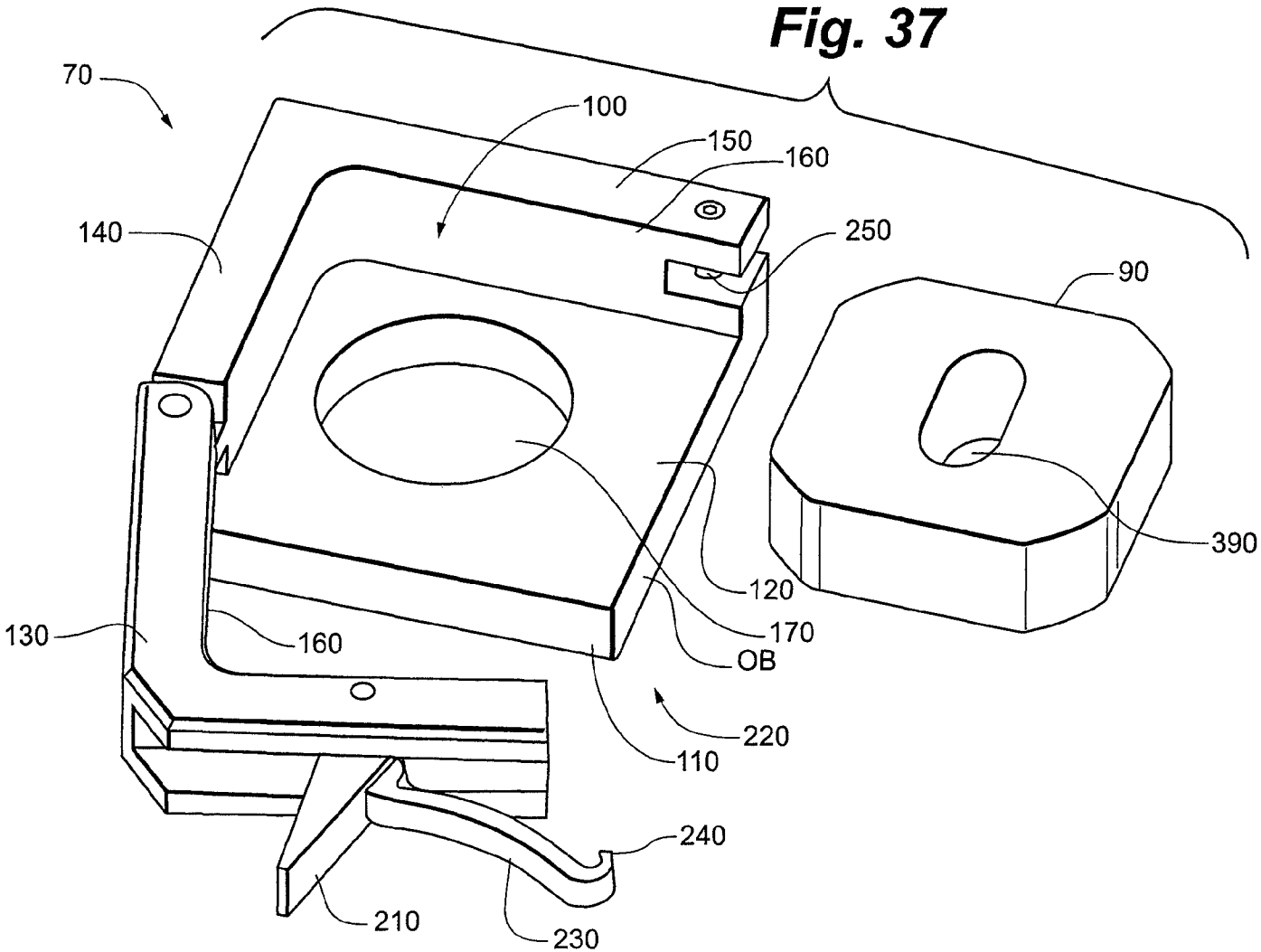
FIG. 37 is a perspective view of a de holder and die in accordance with certain embodiments of the invention.
Figure 38:
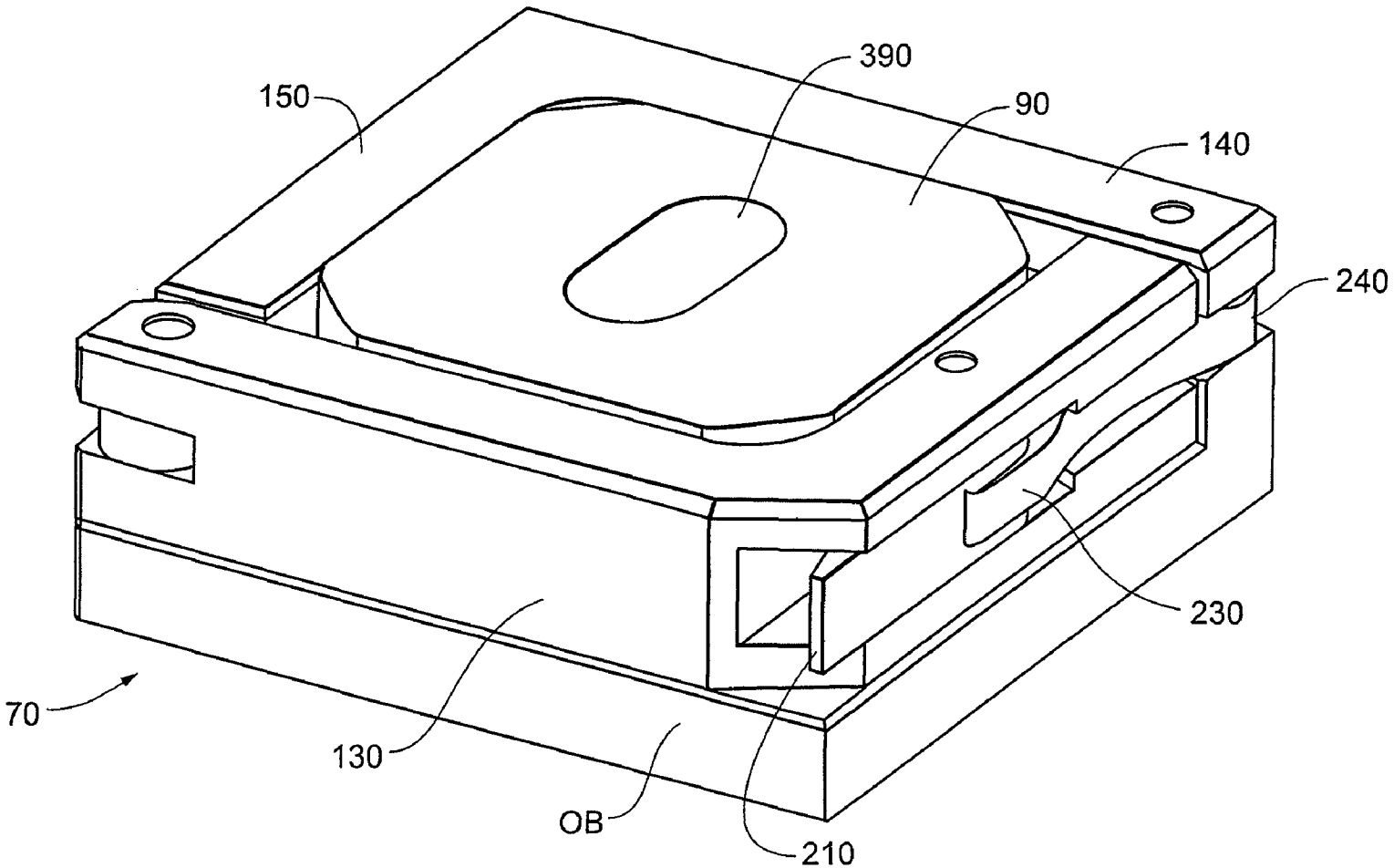
FIG. 38 is a perspective view of the die holder and die of FIG. 37, with the die holder clamped on the die.

The die holder 70 can include any apparatus useful for holding a die 90. Preferably, the die holder 70 has an interior recess 100. The interior recess 100 may have a generally circular configuration (and/or it may be adapted to receive a die having a generally circular configuration). This, however, is not the case in all embodiments. For example, other embodiments involve a polygonal die 90 and a polygonal interior recess 100. Polygonal dies of the Salvagnini style are known, and the present die holder can be configured to accommodate such dies. FIGS. 37 and 38 depict one embodiment of a die holder 70 adapted to retain a polygonal (e.g., generally square) die. Embodiments like that of FIGS. 37 and 38 are described below in more detail.

Figure 3:
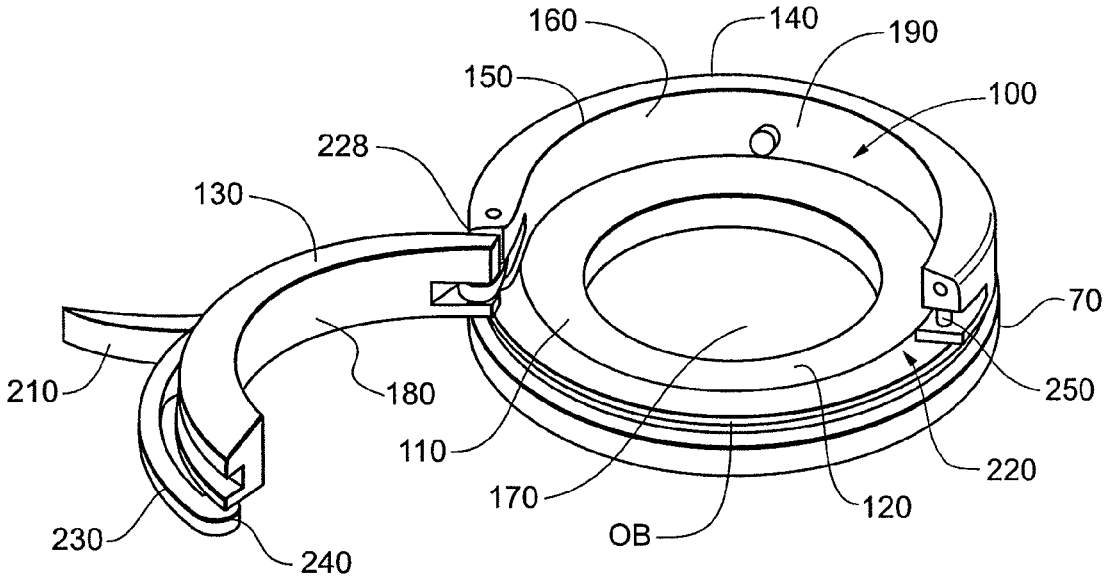
FIG. 3 is a perspective view of the die holder of FIG. 2 in an open configuration in accordance with an embodiment of the invention.

The die holder preferably has a shelf 110 adapted to support a bottom (e.g., a planar base) of a die 90. Reference is made to FIG. 3. The shelf, for example, can have (e.g., can define) a support surface 120 on which the bottom of a die is adapted to rest (e.g., when the die is operably mounted in the die holder). In some embodiments, the die holder has a shoulder 150 defining at least part of the die holder's interior side surface 160, which optionally extends at least generally (e.g., substantially) orthogonally from the shelf 110. The shoulder 150 can bound the interior recess 100. When the die holder is in the closed configuration, the die holder's interior side surface 160 (at least part of which preferably is defined by the shoulder 150) can optionally entirely surround the interior recess 100. Further, the die holder 70 can have a central opening 170 (optionally one through which slugs of workpiece material can drop during certain metal fabrication operations), and the shelf 110 can encompass (e.g., can optionally entirely surround) the central opening 170. In some cases, the die holder has an opening base OB one side of which bounds the central opening 170 and another side of which defines an outer perimeter of the die holder.

In some embodiments, the die holder 70 includes a clamp portion 130 and a wall portion 140. The clamp portion 130 can optionally comprise (e.g., can be) a concave clamp portion (i.e., it can optionally have a concave interior surface). Additionally or alternatively, the wall portion 140 can optionally comprise (e.g., can be) a concave wall portion.

In some embodiments, the clamp portion 130 and wall portion 140 cooperate to allow the die holder 70 to have a closed configuration, embodiments of which are shown in FIGS. 1, 2, 5, 8, 9,12,13,17, 20, 21, 33, 36, 38, and 40, and an open configuration, embodiments of which are shown in FIGS. 3, 4, 6, 7, 10, 11, 14-16, 22, 23, 34, 37, and 39. Preferably, in the closed configuration, the clamp 130 and wall 140 portions together surround the interior recess 100 (optionally entirely surrounding the interior recess, substantially entirely surrounding the interior recess, or surrounding the interior recess to such an extent that a die cannot be mounted in the die holder by simply sliding the die sideways through any side opening). In the open configuration, the die holder 70 preferably is configured to allow a die 90 to be placed in the die holder 70 or removed from the die holder 70. In some embodiments, when the clamp 130 and wall 140 portions are positioned in the closed configuration, the die holder 70 has a generally annular configuration (and/or at least has a generally circular interior side surface 160 surrounding the interior recess 100). In some embodiments, the die holder has configurations like those shown in FIGS. 18, 19, or 37-40. Other die holder configurations can also be provided with the features of any embodiment described in the present disclosure.

The terms "concave clamp portion" and "concave wall portion" do not require the whole of either component to be concave. Preferably, though, a concave clamp portion 130 has a concave interior surface 180, and a concave wall portion 140 has a concave interior surface 190. Those interior surfaces desirably are adapted to surround, abut, and/or engage a die 90 when the die is mounted in the die holder 70 and the die holder is in the closed configuration.

In some embodiments, a concave interior surface 180 of the clamp portion 130 bounds at least 30 degrees, at least 35 degrees, or at least 40 degrees of the interior recess 100 when the clamp and wall portions are in the closed configuration. FIGS. 33-36 exemplify embodiments wherein the die holder 70 has a clamp portion 130 (optionally defining a concave interior surface 180) that encompasses more than 180 degrees of the interior recess 100. Embodiments of this nature can be particularly advantageous. For example, such a clamp portion 130 can be sized to press fit on the die such that the clamp portion retains the die when the clamp portion is pulled off (e.g., moved sideways apart from) the wall portion 140.

Figure 16:
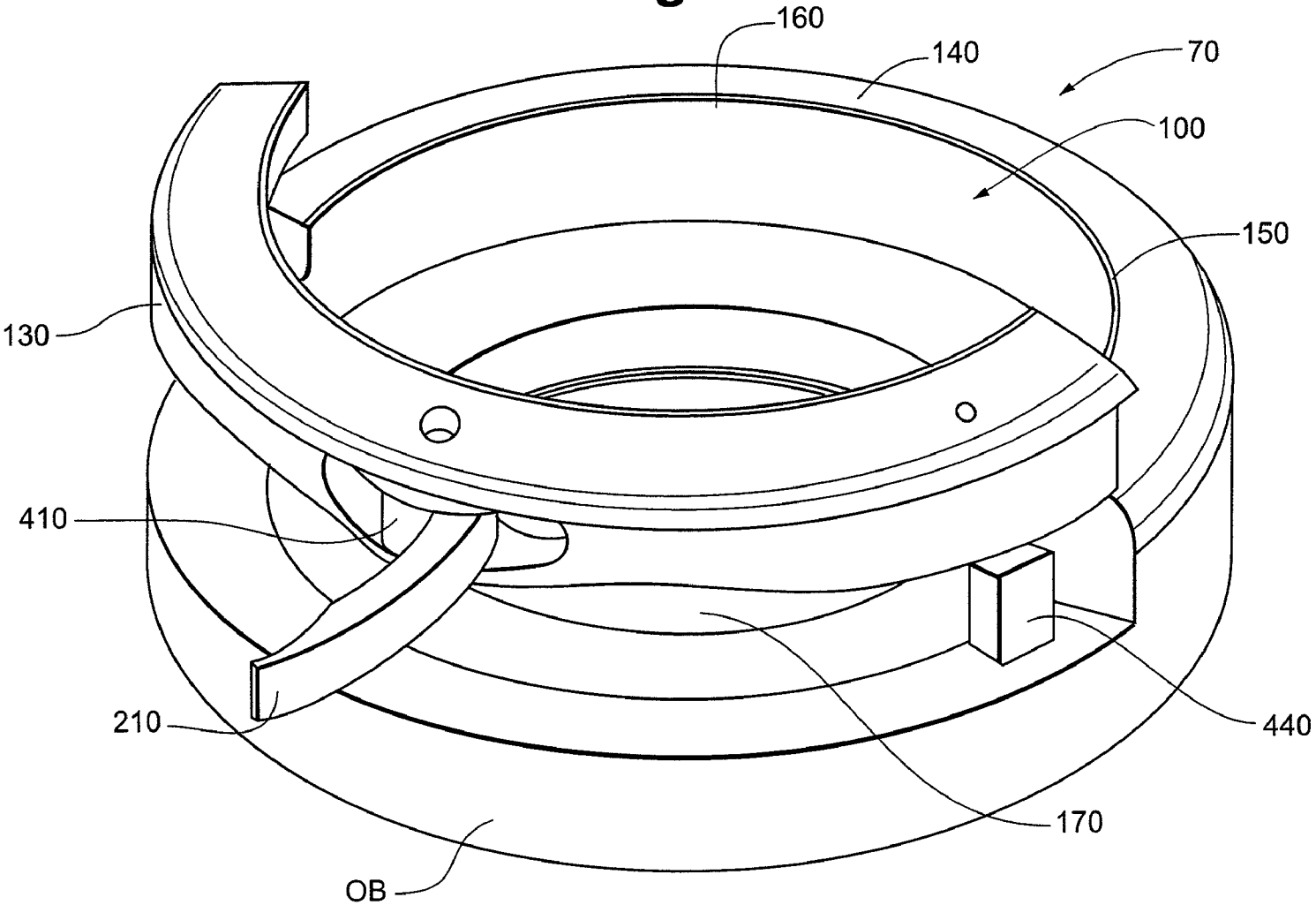
FIG. 16 is a perspective view of a die holder in accordance with another embodiment of the invention.
Figure 17:
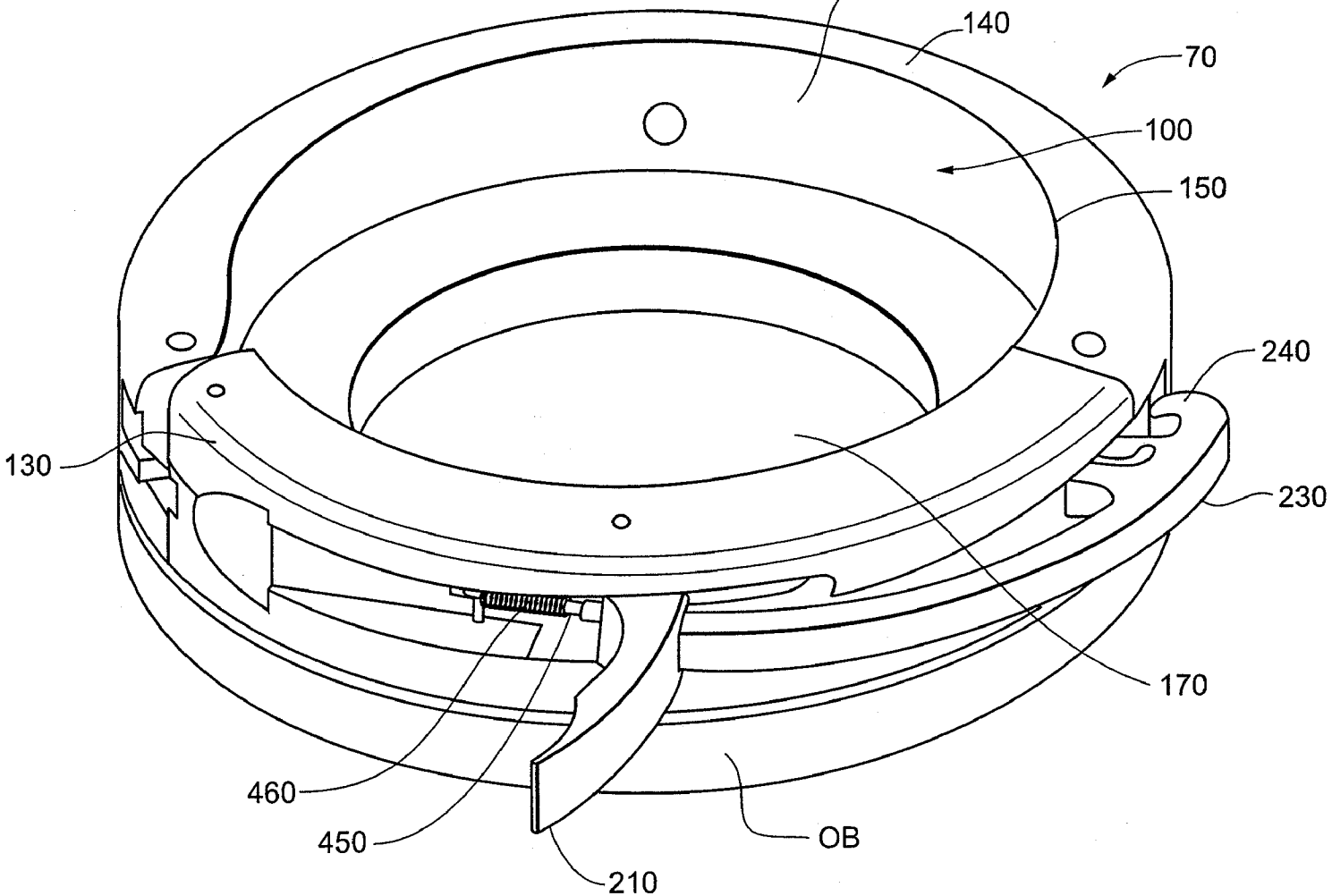
FIG. 17 is a perspective view of a die holder in accordance with another embodiment of the invention.

In certain embodiments, the die holder 70 also has a clamped configuration, embodiments of which are shown in FIGS. 1, 2, 5, 8, 9, 12, 13, 20, 21, 33, 36, 38, and 40, and an unclamped configuration, embodiments of which are shown in FIGS. 3, 4, 6, 7, 10, 11, 14-16, 22, 23, 34, 37, and 39 (also in the open configuration) and in FIG. 17 (also in the closed configuration). The clamped configuration is useful for securely clamping a die 90 in the die holder 70. The unclamped configuration is useful for allowing the die holder 70 to be reversibly placed in either the open configuration or the closed configuration. In some embodiments, the die holder can be adjusted from an unclamped configuration to a clamped configuration by performing a clamping operation, and the die holder 70 can be adjusted from the clamped configuration to the unclamped configuration by performing an unclamping operation.

In certain embodiments, the die holder 70 includes at least one spring component. In some cases, the spring component comprises a body comprising (e.g., formed of) spring steel. For example, a spring steel body (optionally having an arcuate shape) can form at least part of the die holder's clamp portion 130. During a clamping operation, the die holder 70 can apply a clamping force on a die 90 (when the die is in the die holder's interior recess 100) and the optional spring component may generate at least part of the clamping force. In such embodiments, when the clamp and wall portions are in the closed configuration, the clamping operation preferably can be performed so as to decrease a dimension, such as a diameter, of the interior recess (this may be the case for any embodiment described in this disclosure).

In some embodiments, the die holder includes an actuator 210. The actuator preferably is adapted to be moved (e.g., manually, or in some cases robotically or otherwise using hydraulics, pneumatics, electronics, magnetics, or the like) in such a way as to move the die holder between its clamped and unclamped configurations.

In one group of embodiments, the die holder is provided with an actuator 210 comprising a body that moves relative to the clamp portion 130 and/or wall portion 140 during clamping and unclamping operations. The moveable body can optionally be a pivotable body that moves pivotally (e.g., about at least one hinge) during the clamping and unclamping operations. The pivotable body, for example, can be a handle or a latch. FIGS. 33-36 depict one exemplary embodiment involving a latch.

In certain embodiments, the die holder 70 is a tool-free die holder. The actuator 210 in such embodiments is a tool-free actuator such that both the clamping and unclamping operations are tool-free operations (and/or they do not involve rotating a set screw or any other threaded fastener). The clamping operation, for example, may be one that can be performed without a wrench or screw driver. Components of the die holder itself, even if removable (e.g., a removable handle actuator), are not considered tools for purposes of the present disclosure. As described below, some embodiments provide a die holder (which can optionally be a tool-free die holder) that can be clamped and unclamped, and/or adjusted between open an closed configurations, without requiring any assembly or disassembly of the die holder.

In certain embodiments, the actuator 210 is a single-motion actuator, which allows the die holder 70 to be clamped or unclamped with a single motion. A die holder 70 with a single-motion actuator 210 can be clamped on a die 90 in the interior recess 100 in response to a single motion of the actuator 210, and preferably can be unclamped in response to a single motion of the actuator 210. In some embodiments of this nature, the die holder may need to be partially assembled (e.g., the clamp portion may need to be joined to the wall portion, and/or a removable handle may need to be joined to the die holder) before the single-motion clamping can be performed, and/or the die holder may simply need to be moved from an open configuration to a closed configuration, before the single-motion clamping can be performed. However, the actual clamping in such embodiments occurs in response to a single motion of a single-motion actuator (preferably, the same is true of the actual unclamping). Exemplary single motions can be pivoting, pressing, sliding, or squeezing the actuator 210.

In some embodiments, the die holder 70 is provided with an actuator 210 comprising a body (e.g., a handle) that is moved in one direction (once or repeatedly) during the clamping operation and in another direction (optionally an opposite direction) during the unclamping operation. In embodiments involving a die holder 70 with a shelf 110 defining a support surface 120 on which the bottom of a die 90 is adapted to rest, the handle or other body can optionally be moveable in a plane that is at least generally parallel (or at least substantially parallel) to the shelf's support surface (such that the handle or other body moves in that plane to cause the clamping and unclamping operations). If such a die holder 70 is on, for example, a horizontal table (optionally a lower table 40, as shown in FIG. 1) of a metal-fabricating press 10, then during clamping and unclamping operations the handle or other body may be adapted to move horizontally. If such a die holder is mounted on a turret press (or another press having a gap between upper and lower tables), then the gap 50 can be a generally horizontal gap, and the single-motion actuator 210 can optionally comprise a handle that is moved at least generally horizontally during clamping and unclamping. Other examples include moving the actuator (optionally a latch or handle thereof) generally orthogonally to the generally horizontal gap (e.g., in a generally upward or downward direction) or at an oblique angle. FIGS. 33-36, for example, depict a latch that moves in a plane substantially perpendicular to the die holder's support surface 120 during clamping and unclamping.

In some embodiments, when the clamp and wall portions 130, 140 are in the open configuration, a die 90 can be mounted in the die holder 70 by moving the die sideways (in some cases, horizontally) through an open side 220 of the die holder. Reference is made to FIGS. 3, 4, 6, 7, 10, 11, 14, 15, 16, 22, 23, 34, and 37. Next, the clamp and wall portions 130, 140 can be positioned in the closed configuration, and the clamping operation can be performed to securely clamp the die holder on the die, as shown in FIGS. 1, 2, 5, 9, 12, 20, and 38.

In certain embodiments, the die holder is mounted on a table (optionally a horizontal table) of a metal-fabricating press in such a way that when the clamp and wall portions 130, 140 of the die holder 70 are in the open configuration, an open side of the die holder faces an exterior perimeter 224 of the metal-fabricating press 20. Reference is made to FIG. 1. Such embodiments facilitate easy changing of dies in the press by minimizing the amount of work that must be done in the gap between the upper and lower tables. Various embodiments of the die holder 70 will now be described in more detail.

Figure 4:
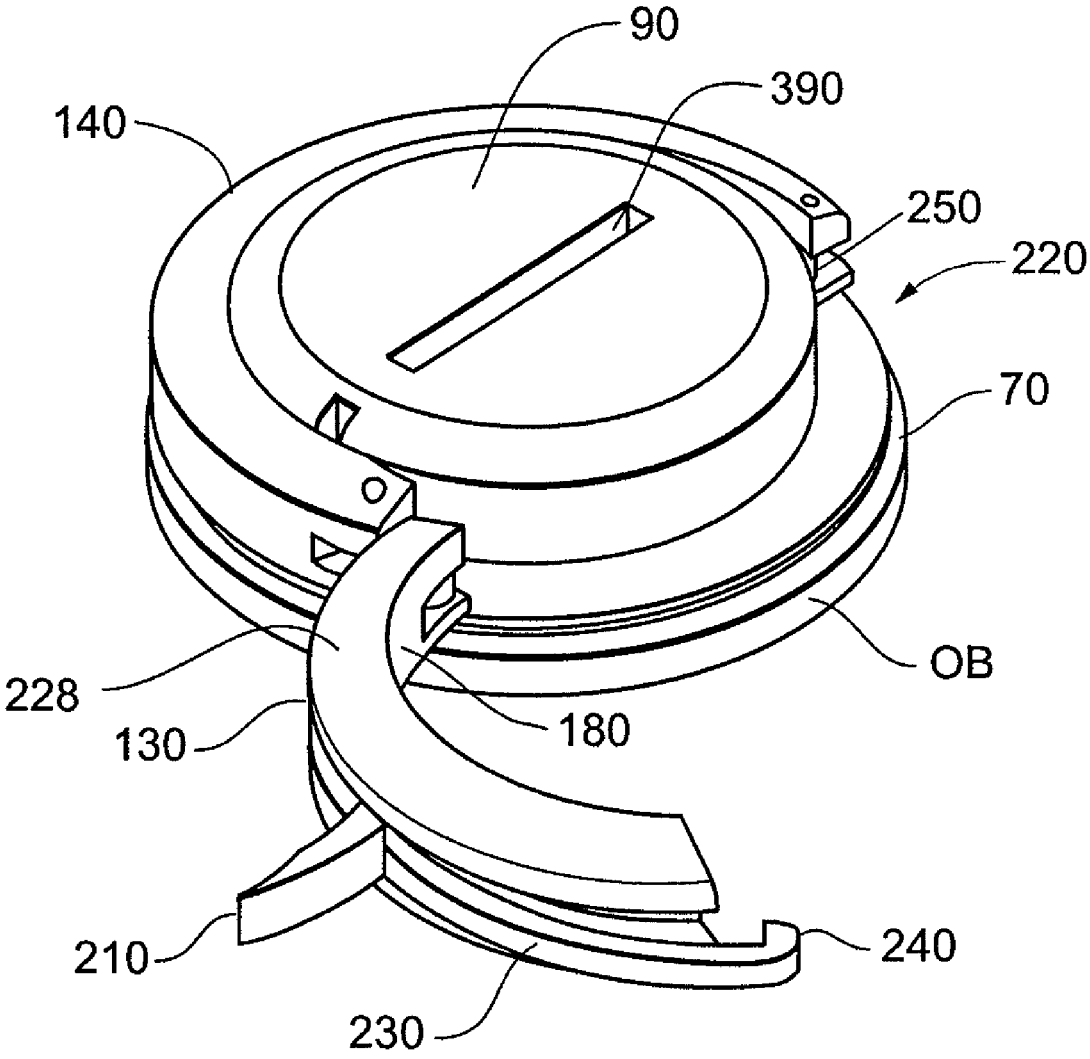
FIG. 4 is a perspective view of the die and die holder of FIG. 2 in an open configuration in accordance with an embodiment of the invention.
Figure 5:
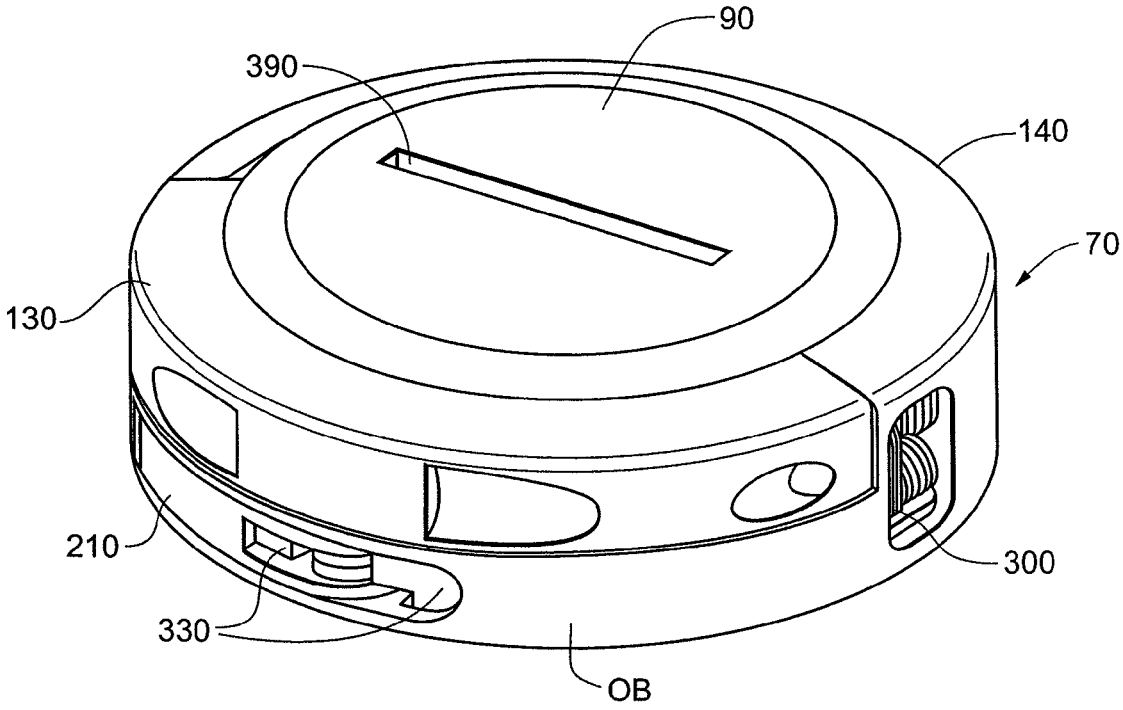
FIG. 5 is a perspective view of a die and a die holder in accordance with another embodiment of the invention.
Figure 6:
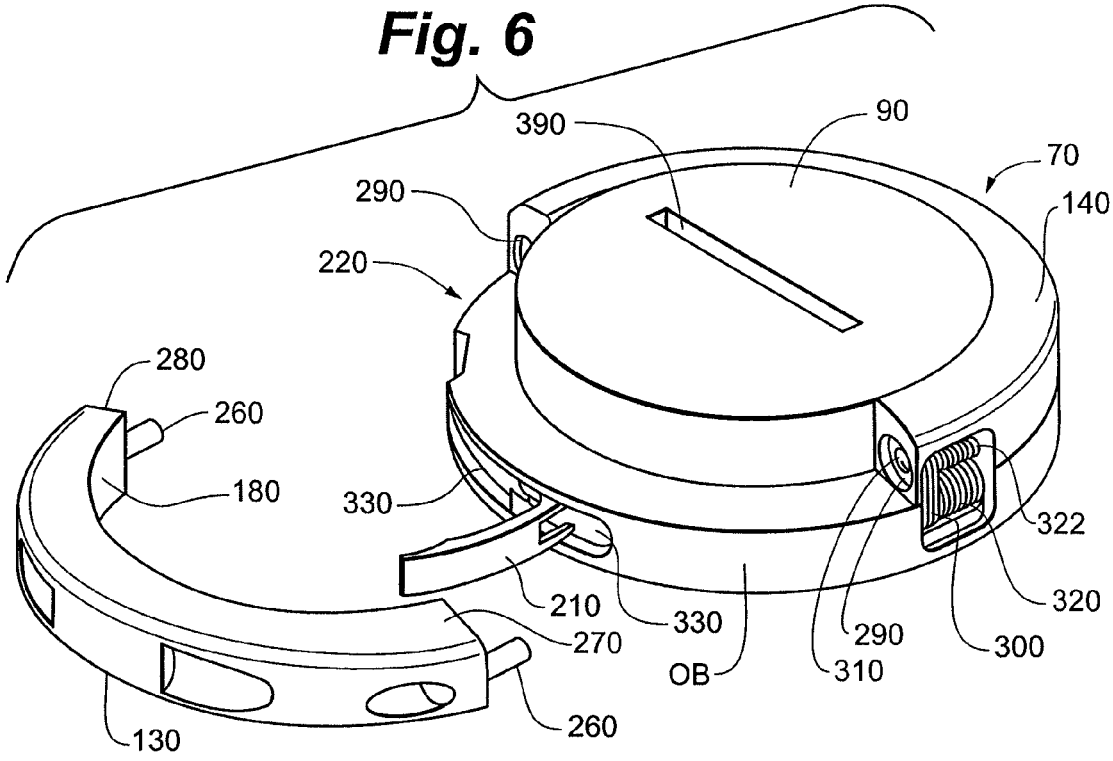
FIG. 6 is a perspective view of the die and die holder of FIG. 5 in an open configuration in accordance with an embodiment of the invention.
Figure 7:
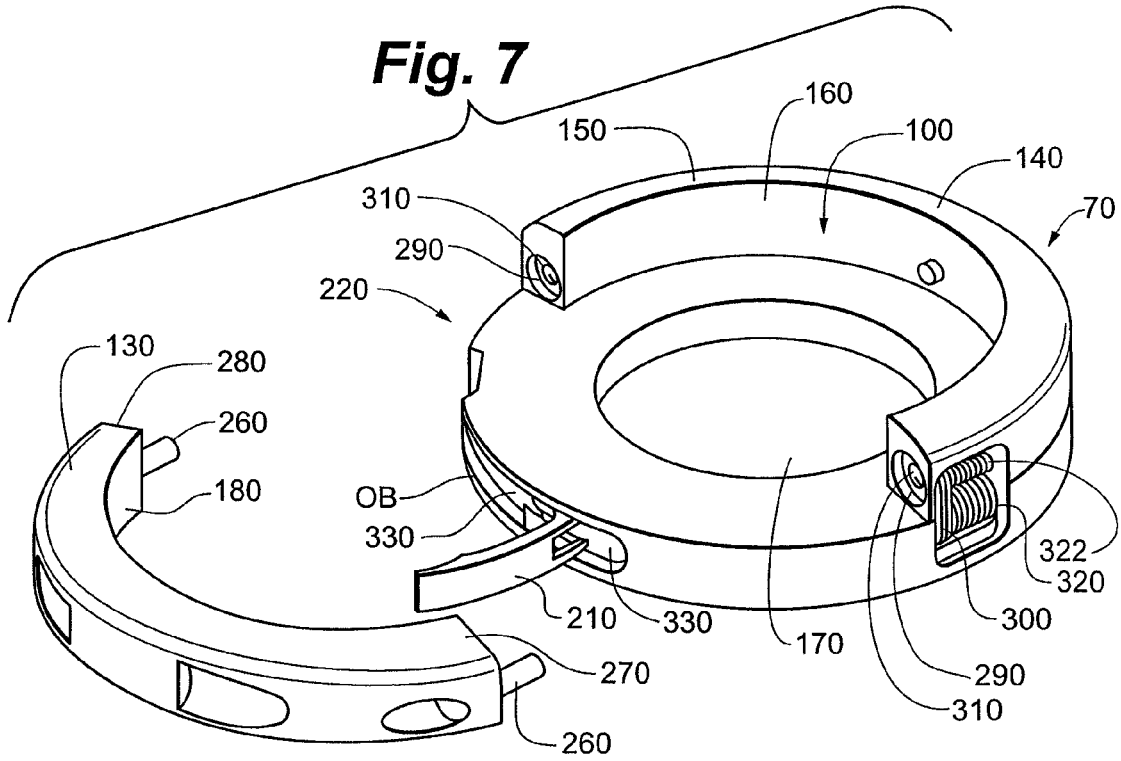
FIG. 7 is a perspective view of the die holder of FIG. 5 in an open configuration in accordance with an embodiment of the invention.

As shown in FIGS. 2-4, some embodiments include a die holder 70 with a clamp portion 130 that is hingedly joined (e.g., about a hinge 228) to a wall portion 140 such that the clamp and wall portions can be moved between the closed configuration, as shown in FIG. 2, and the open configuration, as shown in FIGS. 3 and 4, by pivoting the clamp portion 130 relative to the wall portion 140. Here (as in other embodiments), the clamp portion 130 can optionally be a concave clamp portion, the wall portion 140 can optionally be a concave wall portion, or both.

In the embodiment shown, the clamp portion 130 includes a latch 230, and the latch is hingedly joined to the clamp portion and has a free end 240 that can be hooked onto a catch 250 on the wall portion 140. The illustrated latch 230 has a generally arcuate shape, although this is not required. The clamp portion also includes an actuator 210 connected to the latch 230 (optionally connected pivotably) and adapted to pull the free end 240 of the latch 230 tight against the catch 250 on the wall portion 140 as part of the clamping operation. This exemplifies embodiments where the die holder 70 is adapted for being clamped and unclamped without any assembly or disassembly of the die holder. Thus, one group of embodiments provides a die holder adapted for being clamped and unclamped without any assembly or disassembly. Another embodiment of this nature is shown in FIG. 17.

In other cases, the closed configuration involves the clamp portion 130 being attached removably to the wall portion 140, as exemplified in FIGS. 5, 8, 9, 12, 13, 33, and 40, and the open configuration involves the clamp portion being removed from (e.g., completely separated from) the wall portion, as exemplified in FIGS. 6, 7, 10, 11, 16, 34, and 39.

In the embodiment shown in FIGS. 5-8, the clamp portion 130 has two clamp posts 260 extending respectively from each of its two ends 270, 280. The illustrated wall portion 140 has corresponding clamp post apertures 290 adapted to receive the clamp posts 260 when the die holder 70 is placed in the closed configuration. This arrangement can optionally be reversed (e.g., the clamp posts can extend from the ends of the wall portion, and the post-receipt apertures can be formed in the ends of the clamp portion), or one end of the clamp portion can have a post while the other end of the clamp portion has a post-receipt aperture adapted to receive a post extending from the wall portion. Other variations of this nature are anticipated.

Figure 8:
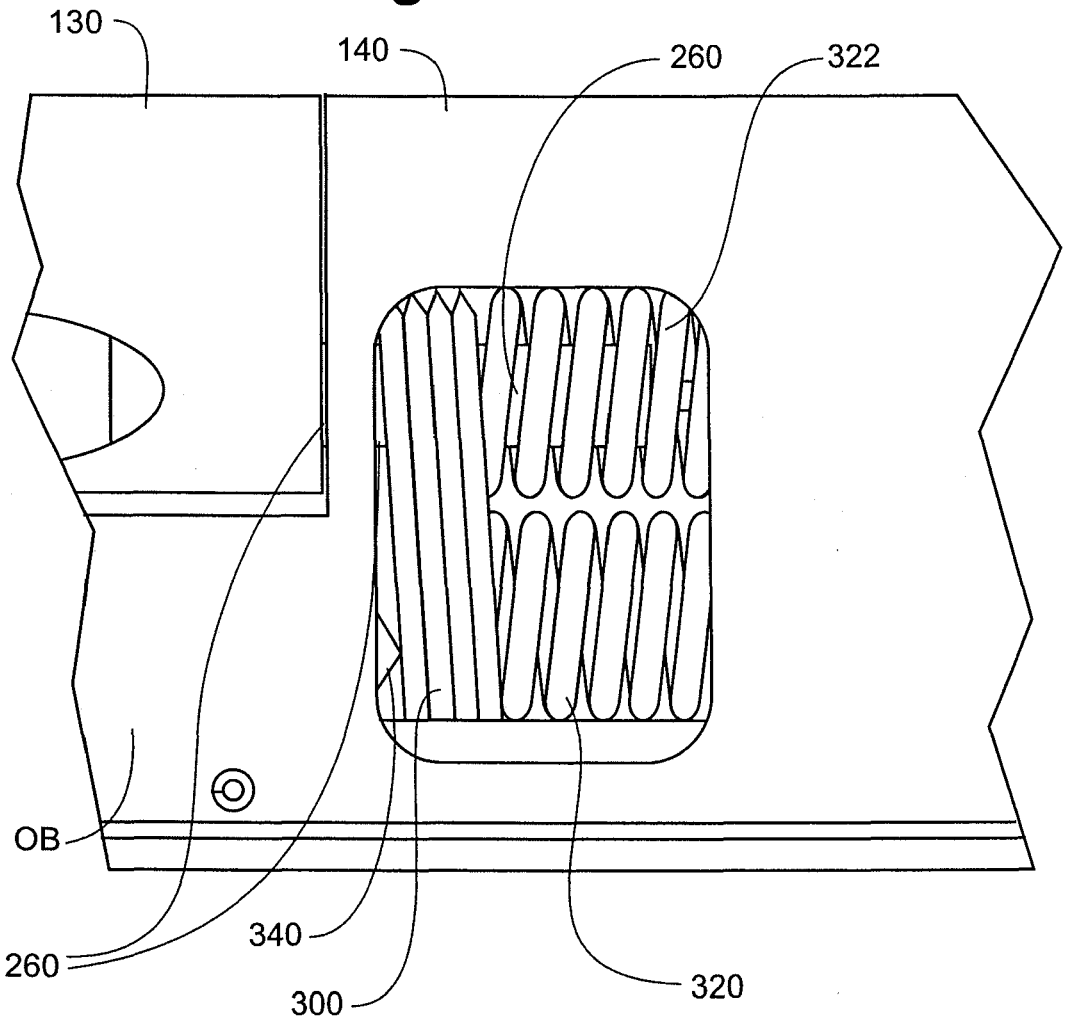
FIG. 8 is a side detail view of a portion of the die holder of FIG. 5 in accordance with an embodiment of the invention.

In some embodiments, one or more pinch plates (e.g., a stack of contiguous pinch plates) 300 can be included in the die holder's wall portion 140, as shown best in FIG. 8. The pinch plates 300 can have pinch plate apertures 310 aligned with the clamp post apertures 290. In such embodiments, when a clamp post 260 is inserted through a clamp post aperture 290, the post moves into a pinch plate aperture 310. First and second pinch plate springs 320, 322 can movably hold the pinch plates within a recess defined by the wall portion 140. In an unbiased configuration (e.g., when the die holder 70 is in the open configuration), the pinch plate springs 320, 322 hold the illustrated pinch plates 300 in a substantially perpendicular orientation relative to an axis of the clamp post apertures 290 such that the clamp post apertures 290 are aligned (e.g., share a common axis) with the respective pinch plate apertures 310. Preferably, the pinch plate apertures 310 are positioned and sized to receive respective posts 260. For example, when the pinch plates are in a substantially perpendicular orientation relative to the axis of the clamp post aperture 190, the clamp posts can be readily moved through the clamp post apertures 290 and into the pinch plate apertures 310. To then place the die holder 70 in the clamped configuration, significant binding forces are applied on the clamp posts 260 when the pinch plates 300 are moved into a skewed position relative to the clamp posts. During the process of applying binding force on the clamp posts, the pinch plates can optionally pull the clamp portion 130 tighter against the wall portion 140 so as to clamp the die holder securely on a die mounted therein. The binding forces preferably are large enough to retain the die within the die holder during metal fabrication operations.

The pinch plates 300 can be placed into a significantly skewed position relative to the clamp posts in any suitable manner. In the embodiment shown in FIGS. 5-8, the die holder 70 includes an actuator (optionally comprising a handle) 210 that is pivotably coupled to the die holder. As the actuator is pivoted, it forces an actuating member 330 to articulate along (e.g., through) a wall of the die holder. The actuating member 330 has an end portion 340 that exerts force against the pinch plates 300 as the actuator 210 is pivoted in a desired direction. In more detail, the actuator 210 is pivoted in the desired direction to cause end portion 340 to exert force against the pinch plates 300 so as to bind the clamp posts 260 to the wall portion 140 of the die holder 70. When it is desired to unclamp the die holder, the actuator 210 can be pivoted in an opposite direction so that the end portion 340 of the actuating member 330 moves away from the pinch plates 300, allowing the springs 320, 322 to move the pinch plates 300 back to their default position (preferably a non-skewed position). In the embodiment of FIGS. 5-8, the actuator 210 causes two actuating members to move respectively toward two stacks of pinch plates, as is perhaps best appreciated with reference to FIG. 6.

A binding-force mechanism like that in FIGS. 5-8 can be provided with a variety of different actuator types. For example, a powered solenoid can be used to push a stack of pinch plates into a skewed position. Alternatively, a ratchet-type handle can be adapted for being cranked repetitively in such a way that pneumatic or hydraulic pressure builds within a chamber of the die holder, causing a piston or the like to move the pinch plates into a skewed position. Electromagnetic actuators could also be used to push such pinch plates into a skewed position. Other embodiments involve such pneumatic, hydraulic, or electromagnetic actuators being adapted to move a moveable body mounted on the clamp portion or wall portion directly against the die to effect clamping.

Figure 9:
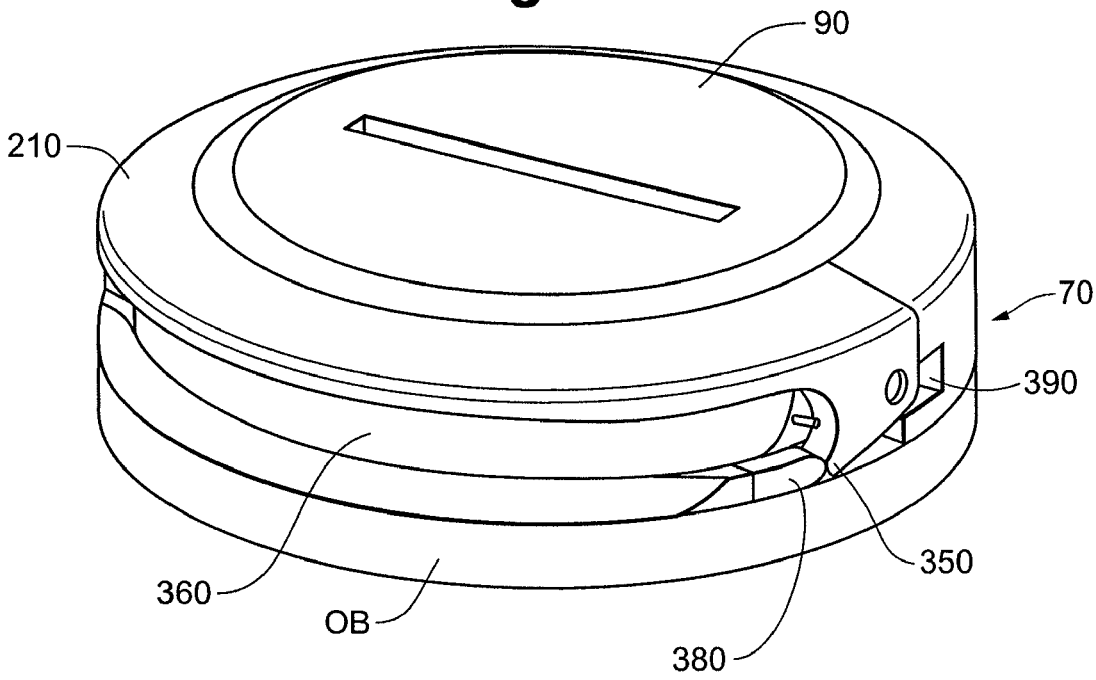
FIG. 9 is a perspective view of a die and a die holder in accordance with another embodiment of the invention.
Figure 10:
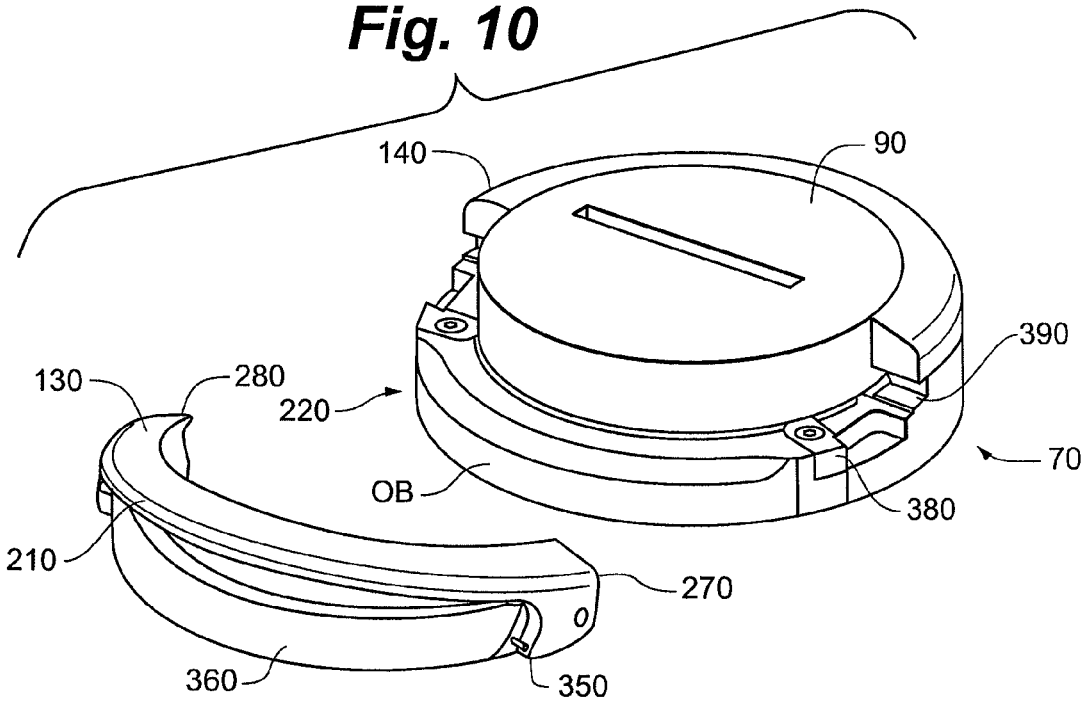
FIG. 10 is a perspective view of the die and die holder of FIG. 9 in an open configuration in accordance with an embodiment of the invention.
Figure 11:
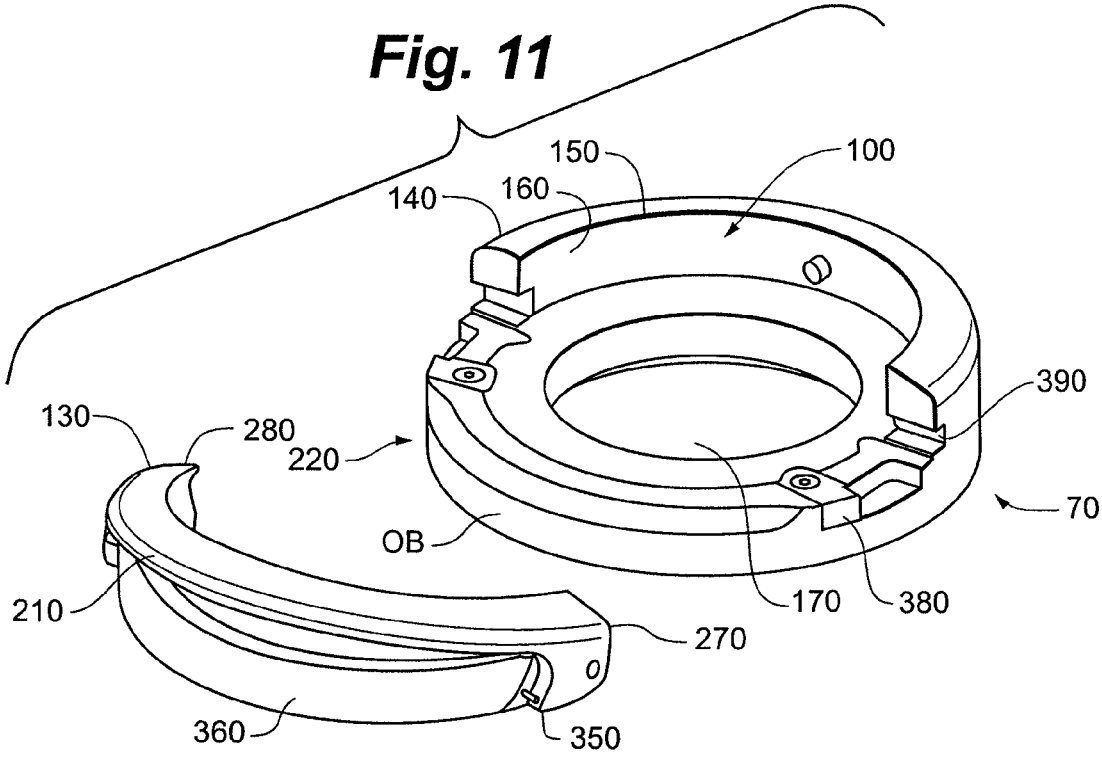
FIG. 11 is a perspective view of the die holder of FIG. 9 in an open configuration in accordance with an embodiment of the invention.

Another embodiment is shown in FIGS. 9-12. FIG. 9 shows the die holder 70 in the closed and clamped configurations, with a die 90 clamped securely in the interior recess 100 of the die holder 70. FIG. 10 shows the die holder of FIG. 9 in the open and unclamped configurations (here, the die 90 is still mounted on the die holder). FIG. 11 shows the die holder of FIGS. 9 and 10 in the open and unclamped configurations after the die has been removed.

In the embodiments of FIGS. 9-12, the clamping operation decreases a dimension, such as a diameter, of the die holder's interior recess 100. (This is preferably a result of clamping the die holder in any embodiment.) The clamp portion 130 (or a component or section thereof) is forced against the die 90 during the clamping operation.

FIGS. 9-12 and 13 exemplify a group of embodiments wherein the die holder has a clamp portion 130 comprising two arcuate bodies (e.g., bars) 210, 360 pivotally joined to each other. The two arcuate bodies 210, 360 preferably are resiliently biased so as to assume an expanded configuration unless they are forced to pivot to a compacted configuration. Here, the die holder's clamping operation involves one of the two arcuate bodies 210, 360 pivoting relative to the other. This pivoting action can optionally be about an axis at least generally parallel to the die holder's support surface 120. When such a clamp portion 130 is mounted on the wall portion 140 and clamped, it ends-up being in its compacted configuration (and stays in this configuration when the die holder is in the clamped configuration).

Figure 12:
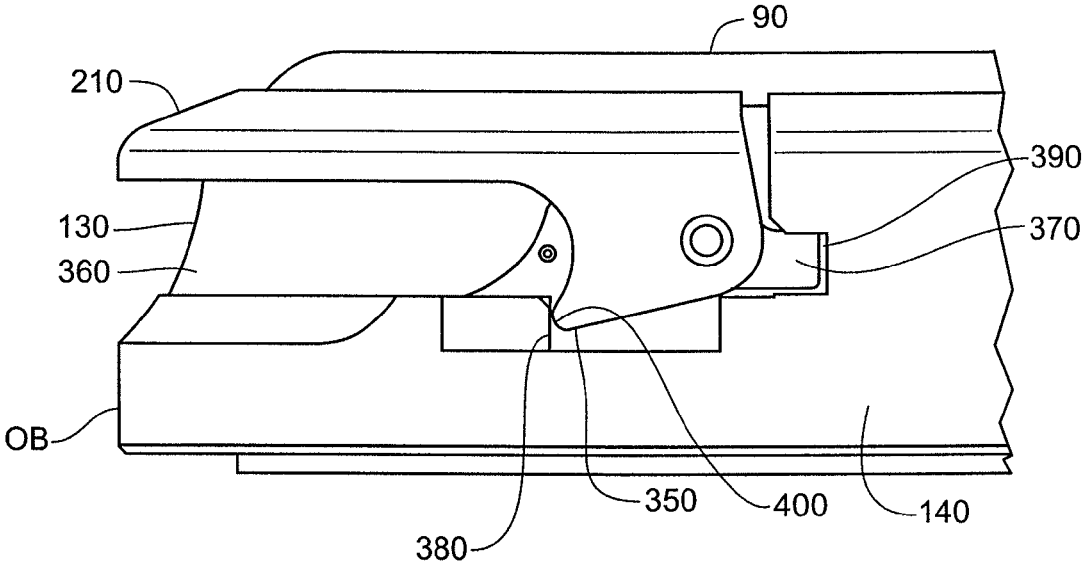
FIG. 12 is a partially broken-away side view of a portion of the die and the die holder of FIG. 9 in accordance with an embodiment of the invention.
Figure 13:
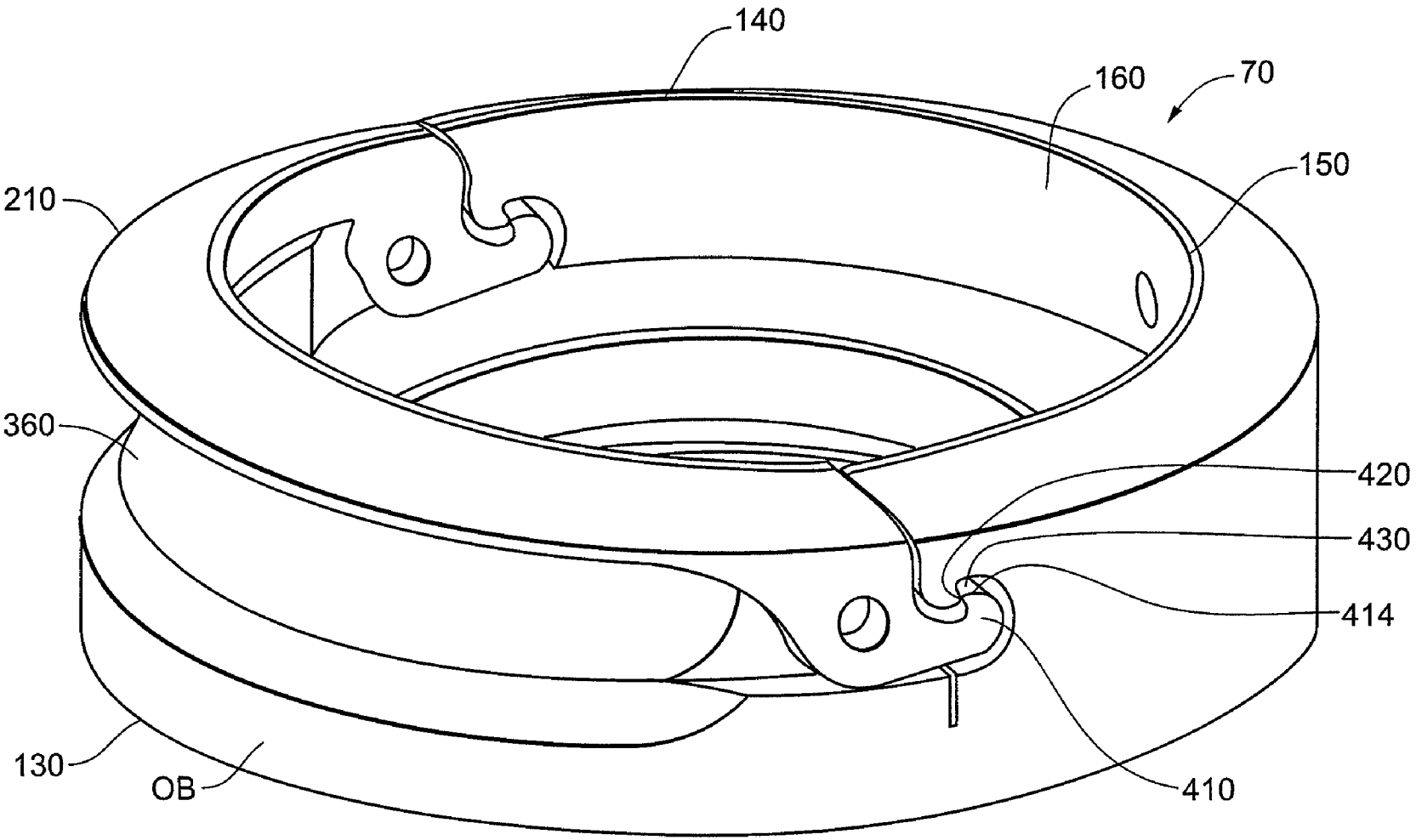
FIG. 13 is a perspective view of a die holder in accordance with another embodiment of the invention.

In FIGS. 9-12, the clamp portion 130 includes an actuator 210 adapted to actuate a clamp cam 350, shown best in FIG. 12. The clamp cam 350, for example, can be proximate an end portion 270, 280 of the clamp portion 130. In the illustrated embodiment, each end portion of the clamp portion 130 has a clamp cam 350. The illustrated actuator 210 is pivotably joined to a clamp bar 360. In some embodiments, the clamp bar 360 comprises (e.g., is) a spring steel bar. The clamp bar 360 can have one or more clamp protrusions 370 extending from each end, as shown best in FIG. 12. (FIG. 13 depicts another useful configuration for such a protrusion.) The die holder 70 can have a clamp shoulder 380 corresponding to each clamp cam 350, and a clamp protrusion receiver (e.g., a recess) 390 corresponding to (e.g., adapted to receive) each clamp protrusion 370.

In such embodiments, the die holder is placed in its closed configuration by placing the clamp protrusions 370 in (or proximate to) the corresponding clamp protrusion receivers 390, and then placing (e.g., securing) each clamp cam 350 against its corresponding clamp shoulder 380. In more detail, the clamping operation here includes applying a force (optionally in a generally downward direction) to the actuator 210 so that it tends to pivot relative to the clamp bar 360 in such a manner that each clamp cam 350 articulates against its corresponding clamp shoulder 380 and forces each clamp protrusion 370 further into its corresponding clamp protrusion receiver 390. In some embodiments, the clamp cam 350 is curved so that, during clamping, it can be articulated to such an extent that an apex 400 of the curve has been articulated against, and forced downwardly past, the contact point with cam shoulder 380. At this point, the die holder will not release the die until a substantial external force is applied to the actuator 210 in the opposite direction (e.g., in a generally upward direction) to articulate the apex 400 of the clamp cam 350 upwardly past the contact point with the cam shoulder 380.

FIG. 13 shows another embodiment of a die holder 70 that includes a clamp portion 130 having a cam 410 with an engagement portion 414. In this embodiment, the clamp portion 130 includes an actuator 210 that has (e.g., defines) the cam 410. The illustrated cam 410 has a generally hook-shaped configuration. The actuator is pivotably coupled to a clamp bar 360. Here again, the clamp bar 360 can optionally comprise (e.g., can be) a spring steel bar. The wall portion 140 includes a receiver portion (e.g., a recess) 430 adapted to receive the engagement portion 414 of the clamp portion 130 and a camming surface 420 adapted for articulation against the cam 410. To place the die holder in its closed configuration, the clamp portion 130 is placed against the wall portion 140 such that the engagement portion 414 is proximate (or within) the receiver portion 430 and the cam 410 is proximate or against the camming surface 420. To then clamp the die holder, a force is applied (e.g., in a generally downward direction) to the actuator 210 to pivot the actuator relative to the clamp bar 360, which causes the cam 410 to articulate against the camming surface 420 so as to force the engagement portion 414 fully into its corresponding recess 430. In some embodiments, the engagement portion 414 and recess 430 are shaped such that they will not disengage until a substantial force is applied to the actuator in a generally opposite direction (e.g., a generally upward direction).

Figure 14:
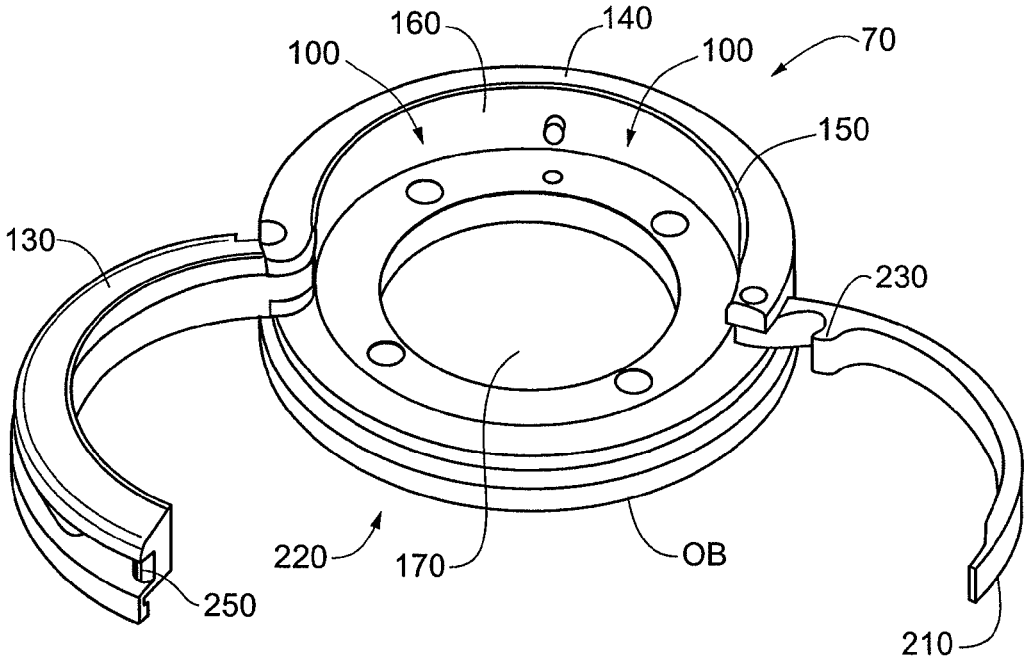
FIG. 14 is a perspective view of a die holder in accordance with another embodiment of the invention.
Figure 15:
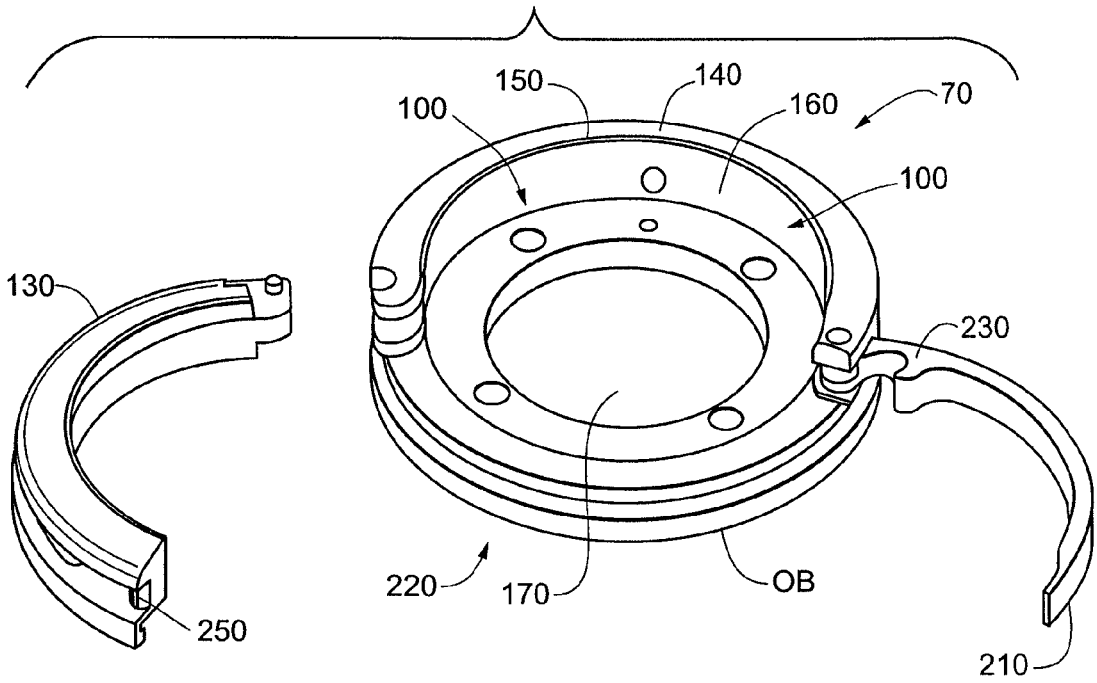
FIG. 15 is a perspective view of the die holder of FIG. 14 in a disassembled configuration in accordance with an embodiment of the invention.

FIG. 14 shows another die holder embodiment. This embodiment includes a clamp portion 130 pivotably coupled with one end of a wall portion 140. An actuator 210 is pivotably joined to another end of the wall portion 140. To place the die holder 70 in a closed configuration, the clamp portion 130 is pivoted relative to the wall portion 140 until the free end of the clamp portion abuts (or is simply adjacent to) the wall portion. To then place the die holder in a clamped configuration, the actuator 210, formed with a latch 230, is pivoted from the opposite end of the wall portion until its latch 230 engages a catch 250 on the clamp portion. Alternatively, the catch 250 could be on the actuator 210 and the latch 230 could be on the clamp portion. The latch 230 and catch 250 can respectively include or operate as a cam and camming surface. The present embodiment is a doubled-hinged die holder 70. Here, the clamp portion 130 is detachable from the wall portion 140, as shown in FIG. 15. Optionally, the actuator 210 can also be detachable from the wall portion 140. Further, it is anticipated that the clamp portion could be attached to the right side of the wall portion (as seen in FIG. 14) and the actuator could be attached to the left side.

FIG. 16 shows an embodiment of a die holder 70 having a clamp portion 130 with an actuator 210 adapted to cause a cam 410 to cam directly against a surface of a die 90 (not shown in FIG. 16) so as to clamp the die. In the embodiment of FIG. 16, the die holder 70 can have shoulders 440, and the clamp portion can have corresponding shoulder receivers (not shown in FIG. 16). In such an embodiment, to place the die holder in a closed configuration, the clamp portion 130 is set on the die holder 70 such that the shoulders 440 are received within the shoulder receivers. To then clamp the die holder, the actuator 210 can be actuated (e.g., a handle thereof can be moved) to articulate the cam 410 directly against a surface of the die. The cam 410, for example, can be curved to allow it to retain the die within the die holder after it has been articulated to such an extent that an apex of the curve has been articulated against, and forced past, the contact point with the die surface. A force can be applied to the actuator in a generally opposite direction to place the die holder in the unclamped configuration. Such embodiments can optionally be provided with a removable handle. For example, the cam 410 can have an opening (not shown) into which a removable handle can be inserted removably when it is desired to rotate the cam (rather than having the handle be integral to the cam 410 as shown in FIG. 16).

FIG. 17 shows an embodiment of a die holder 70 having a clamp portion 130 hingedly connected to the wall portion 140. The embodiment of FIG. 17 also includes an actuator 210 coupled to a latch 230. A free end 240 of the latch 230 can engage a portion of (e.g., a pin or other catch on) the wall portion, and the actuator 210 can then be pivoted relative to the latch 230 to perform the clamping operation. In the embodiment of FIG. 17, a base end of the latch 230 can be coupled to a rod 450 proximate the actuator 210. The rod 450 can be received within a spring 460. As the actuator 210 is closed during the clamping operation, the end of the latch 230 pushes the rod 450 to compress the spring 460. The spring 400 serves to hold the actuator in both the open and closed configurations.

Figure 18:
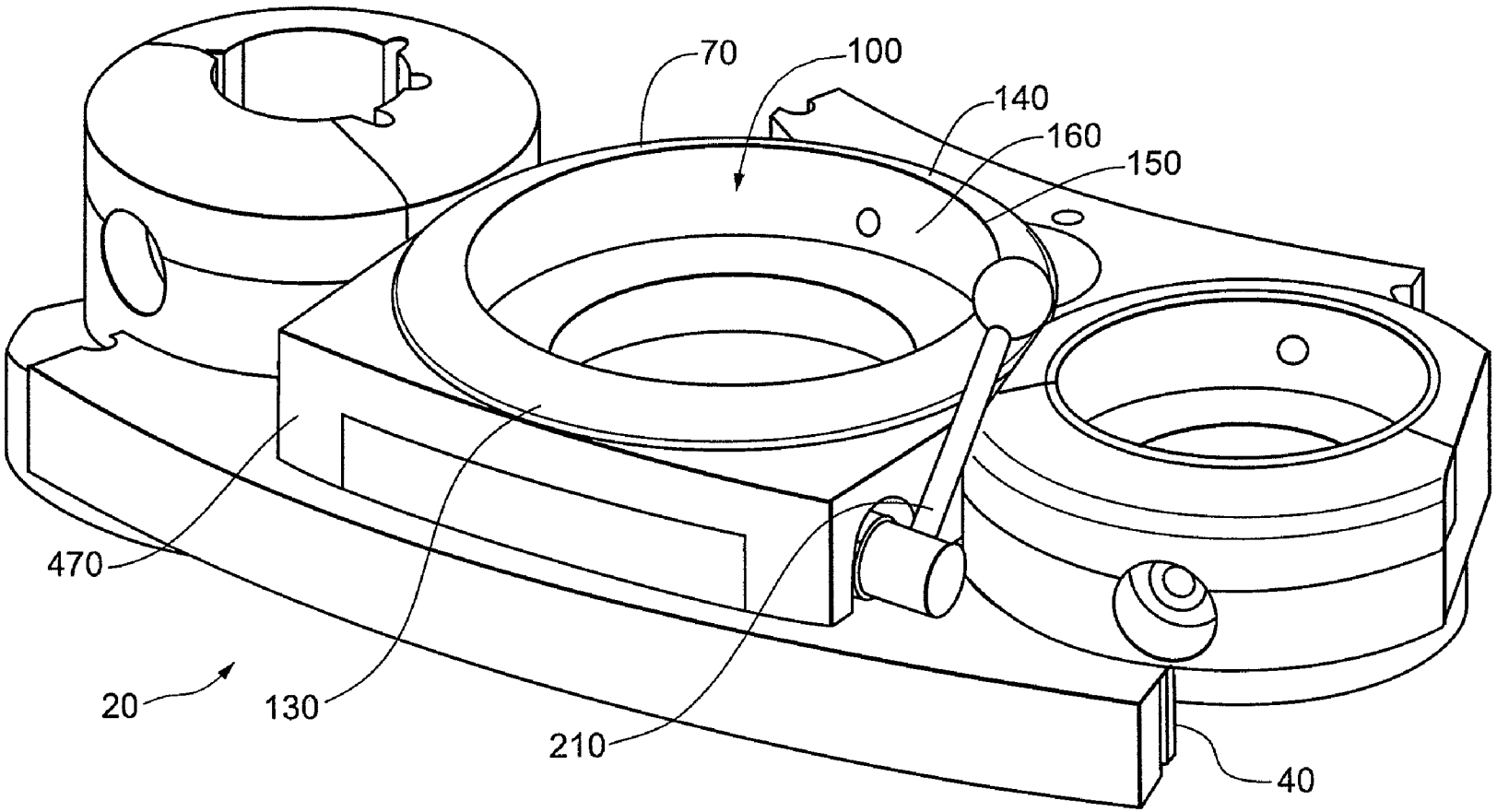
FIG. 18 is a perspective view of a press table with a plurality of die holders in accordance with another embodiment of the invention.

FIG. 18 shows an embodiment of a table 40 of a press 20 carrying a plurality of die holders. The middle die holder 70 has a concave clamp portion 130, a concave wall portion 140, and a single-motion actuator 210. This embodiment illustrates that the outer surface 470 of the die holder can take any shape. Thus, the terms "concave wall portion" and "concave clamp portion" refer to the concave interior surfaces of those components: the exteriors of those components need not be concave.

Figure 19:
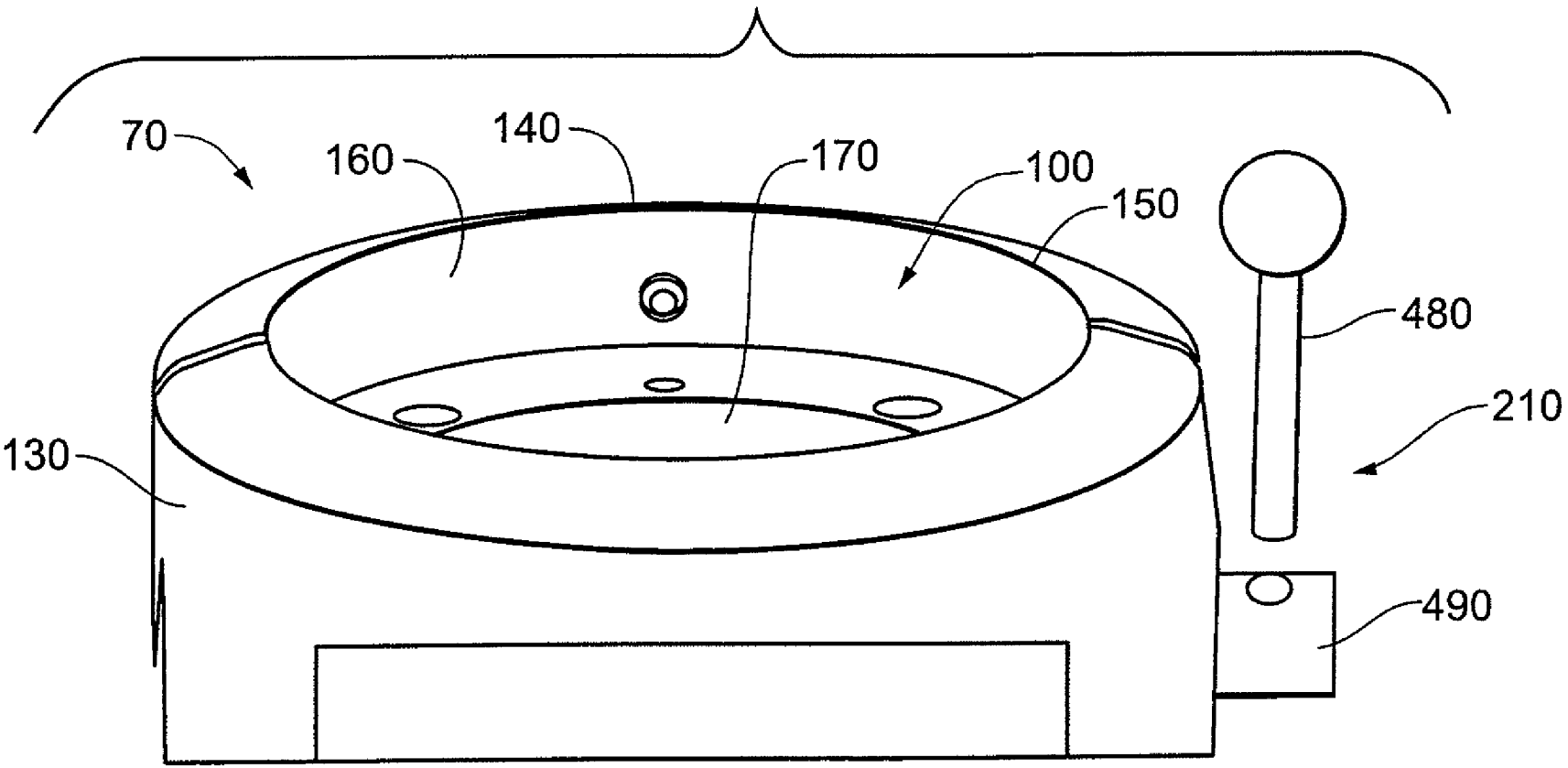
FIG. 19 is a perspective view of a die holder with a removable handle in accordance with another embodiment of the invention.

FIG. 19 shows an embodiment of a die holder 70 having an actuator 210 with a removable handle portion 480 and a base portion 490. In use, the handle portion 480 can be received removably within the base portion 490, and the actuator 210 can be actuated to perform the clamping operation. A removable handle can be provided for other embodiments as well. For example, the handle in FIG. 16 can be removable in much the same manner as the handle in FIG. 19.

Figure 20:
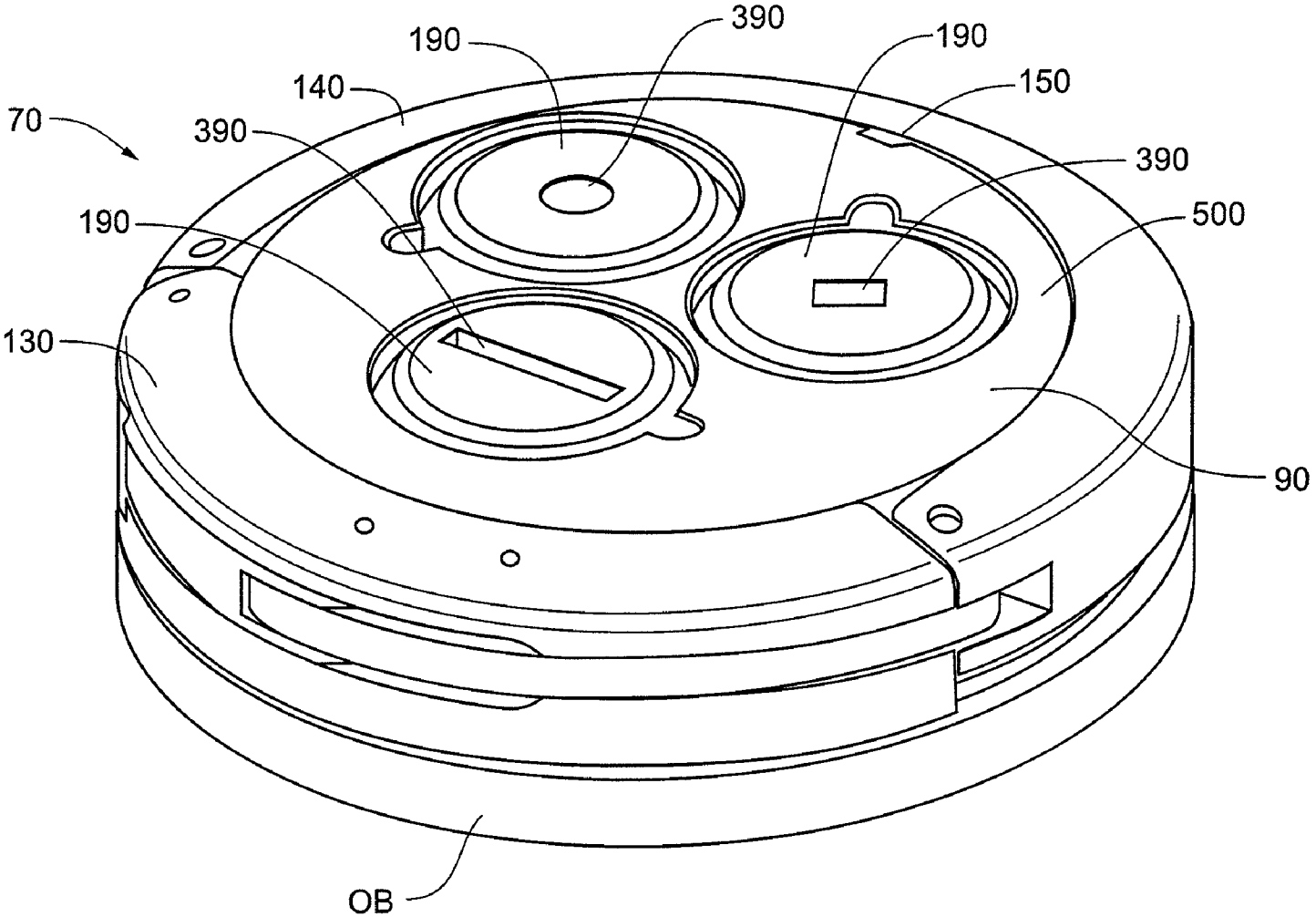
FIG. 20 is a perspective view of a die holder with a die cassette and a plurality of dies in accordance with another embodiment of the invention.

FIG. 20 shows a die holder 70 with its clamp portion 130 and wall portion 140 in the closed and clamped configurations holding a die 90 that is a die cassette 500. The die cassette 500 is adapted to receive a plurality of smaller dies 190. It should be noted that the die cassette 500 can be utilized with any embodiment of the present invention. Thus, a die cassette is considered to be a "die" for purposes of this disclosure.

In connection with the die 90, some embodiments involve an opening 390 that extends entirely through the die. This, however, is not the case in all embodiments.

FIGS. 33-36 depict advantageous die holder features that are provided in certain embodiments of the invention. These figures exemplify embodiments wherein the die holder is designed to reduce or eliminate the stiction problem. The die holder in such embodiments preferably has one (or any combination) of the following features: (1) a shelf 110 adapted to support the bottom of a die, where the shelf has one or more recesses RE, such as grooves or channels (optionally at least one annular groove or channel, and/or a plurality of concentric grooves or channels), pockets, valleys, or other contouring that reduces the extent of contact between the shelf 110 and the bottom of a die mounted operably on the die holder, (2) one or more relief areas RL on the interior surface 160 of the die holder, the relief area(s) being contoured so as to be spaced from a die operably mounted on the die holder, and (3) an interior corner between the die holder's shelf 110 and shoulder 150 having a relief contour (e.g., a radiused or otherwise curved surface extending between shoulder surface 160 and shelf surface 120, where all or part of the radiused or otherwise curved surface is separated from a die operably mounted on the die holder). For embodiments involving one or more of these features, the die holder can have any design described in the present disclosure.

In embodiments where grooves, channels, or other recesses RE are provided in the die holder's shelf 110, the recesses optionally have a depth of at least 0.0015 inch (such as at least about 0.04 mm), or at least 0.0019 inch (such as at least about 0.05 mm). In some cases, the recesses RE reduce the amount of surface area (of the shelf) that contacts a die operably mounted on the die holder by at least 20%, at least 35%, or at least 40% (compared to an entirely flat shelf). In the embodiment of FIGS. 33-36, the shelf 110 has a plurality of concentric grooves and a plurality of annular contact surfaces 120. Many other recess RE arrangements can be used.

In embodiments where the interior surface 160 of the die holder is provided with one or more relief areas RL, a relief area RL may be located circumferentially between two contact areas of the interior surface 160. The interior surface 160 may have one or a plurality of these relief areas RL. When a die is clamped by the die holder, the contact area(s) of the interior surface 160 contact the die, but the relief area(s) RL do not. The relief area(s) may extend from the die holder's shelf all the way up to the top of the die holder's shoulder 150. This, however, is by no means required. In some embodiments, relief areas RL occupy at least 10%, at least 15%, or at least 20% of the die holder's interior side surface 160.

In embodiments where the interior corner relief RS is provided, the relief contour can optionally extend along the entire perimetrical extent (e.g., the entire circumferential extent) of the wall portion 140. This, however, is by no means required. For example, other embodiments involve one or more sections of corner relief RS spanning a total of at least 10 degrees, at least 30 degrees, at least 45 degrees, at least 90 degrees, or at least 120 degrees about the die holder.

FIGS. 37 and 38 depict exemplary embodiments wherein the die holder is adapted to hold a polygonal die. Here, the illustrated die 90 has a generally square configuration. Likewise, the die holder's interior recess 100 has a generally square configuration. Virtually any desired configurations can be used for the die holder's interior recess 100 and the die 90.

The die holder 70 of FIGS. 37 and 38 has a wall portion 140 and a clamp portion 130. The illustrated clamp portion 130 is joined pivotally to the wall portion 140. When it is desired to mount the die 90 in the die holder 70, the die can be moved through the die holder's open side 220 into the interior recess 100. The clamp portion 130 can then be pivoted relative to the wall portion 140 until the die holder reaches its closed configuration. At that point, a latch 230 on the clamp portion 130 is extended so as to attach a hook 240 on the free end of the latch to a catch (e.g., a post, pin, or other suitable structure) 250 on the wall portion 140. An actuator 210 on the die holder is operably coupled (e.g., pivotably attached) to the latch 230. Thus, by pivoting the actuator 210 in a desired direction, the latch 230 is pulled tight against the catch 250 on the wall portion 140, thereby causing the clamp portion 130 to clamp on the die 90. FIG. 38 shows the die 90 in the resulting clamped position.

FIGS. 39 and 40 depict an exemplary embodiment wherein the die holder 70 is adapted to clamp a plurality of dies 90 simultaneously. FIGS. 39 and 40 also exemplify embodiments wherein the die holder 70 has a configuration that can be characterized as being generally pie-shaped. Again, the die holder 70 has a clamp portion 130 and a wall portion 140. The die holder 70 here has an actuator 210, which when actuated is adapted to cause the clamp portion 130 to simultaneously clamp two dies 90 mounted on the die holder. In more detail, the clamp portion 130 has two generally opposed concave surfaces 180, which are adapted to respectively engage the two dies 90 mounted on the die holder. The clamp portion 130 has a generally T-shaped cross-sectional configuration (e.g., in a cross-section taken parallel to the die holder's shelf 110 and/or support surface 120). Other configurations can alternatively be used.

The actuator 210 on the die holder 70 of FIGS. 39 and 40 comprises a handle (on the clamp portion) that moves pivotally to effect clamping and unclamping. The actuator 210 here comprises a bar 910, a first end 902 of which is adapted to be received axially in a corresponding recess 810 in the die holder's wall portion 140. The first end 902 of the bar 910 is equipped with a transverse pin, which is adapted to be received in a corresponding recess 805 open to recess 810. Once the bar 910 has been inserted into recess 810, the actuator 210 can be pivoted to clamp the die holder. In more detail, pivoting the actuator 210 causes the bar 910 to rotate about its axis. This in turn causes the transverse pin 905 on the first end 902 of the bar 910 to cam with a sloped surface in a recess (not shown) open to recess 805. The resulting camming action forces the clamp portion n130 to move tightly against the two dies mounted on the die holder 70. A spring or the like (not show) may provide extra means for keeping the actuator in the clamped position. The illustrated actuator 210 is a handle. However, a rotatable knob or the like could alternatively be used.

In some embodiments, the die holder is moved between the open and closed configurations, and/or between the clamped and unclamped configurations, automatically (i.e., without manually manipulating the die holder, or without any direct human contact). For example, an automatic actuator actuated by electrical, hydraulic, and/or pneumatic power can be utilized for automatically configuring the die holder. Controls for such an automatic actuator can be included with the metal-fabricating press or a control panel. In some embodiments, a programmable robot (e.g., a robotic arm) can be utilized to automatically actuate the actuator. For example, the various die holder embodiments described above can be configured on a press such that they can be clamped and/or unclamped pneumatically, hydraulically, etc.

Some embodiments of the metal-fabricating press include a table (optionally a turret table) with a plurality of die holders. In those cases (or any other cases), each die holder can optionally be an independently-operable die holder such that performing a clamping operation clamps a single die holder alone and does not simultaneously clamp any other tool holder (e.g., any other die holder).

Further, any of the metal-fabricating presses or die holders described herein can include means to indicate that the die is received within, and securely clamped in, the die holder. For example, two electrical contacts can be included within the interior recess and a voltage potential can be applied between the two contacts. The contacts can be configured to allow the circuit to be completed only upon successful clamping of the die within the die holder. The completed circuit could be used to signal an indication light (or other means) on the die holder, on a metal-fabricating press, or on a control panel to indicate the die is either clamped or unclamped. If desired, the press, a controller thereof, etc. can be set-up such that it will not initiate pressing operations unless the die holder registers that a (or each) die therein is securely clamped. Further, the system can be adapted to indicate whether the correct die is received in the die holder. If the correct die is not in the die holder, the controller can be set-up such that it will not initiate pressing. Any signals transmitted among the die holder, a press (e.g., a controller thereof), and a die can be sent by wire or by wireless RF means.

In some embodiments, the invention provides a die holder 70 having a die-release mechanism 520. Preferably, the die-release mechanism 520 is useful for overcoming the above-referenced stiction problem. Several exemplary embodiments, which will be discussed in detail below, are shown in FIGS. 21-28. The present embodiments extend to any die holder having a die-release mechanism of any type described below. The die holder itself may be any one of the types described in this disclosure, or it may have any other desired construction, provided it has a die-release mechanism.

The die-release mechanism is useful for facilitating removal of the die 90 from the die holder 70 by applying a separation force to the die (e.g., so as to overcome stiction force created by lubricant between the die and die holder). In some embodiments, actuating the die-release mechanism 520 involves a contact portion 530 of that mechanism moving at least generally toward a central axis CA of the interior recess (and/or moving at least generally radially inward). Additionally or alternatively, actuating the die-release mechanism 520 may involve a body 524 with a contact portion 530 moving at least generally parallel to (or at least substantially parallel to)

a plane in which the shelf's support surface 120 lies. This may involve the body 524 moving horizontally (e.g., if the die holder is mounted on a table of a press). In certain embodiments, actuation of the die-release mechanism 520 involves a contact portion 530 of that mechanism moving at least generally toward (or directly toward) an open side 80 of the die holder. In some cases, actuation of the die-release mechanism 520 involves a contact portion 530 of that mechanism emerging from an opening OP in the die holder's interior surface 160 (the opening OP can optionally be in a concave interior surface of the die holder).

Figure 21:
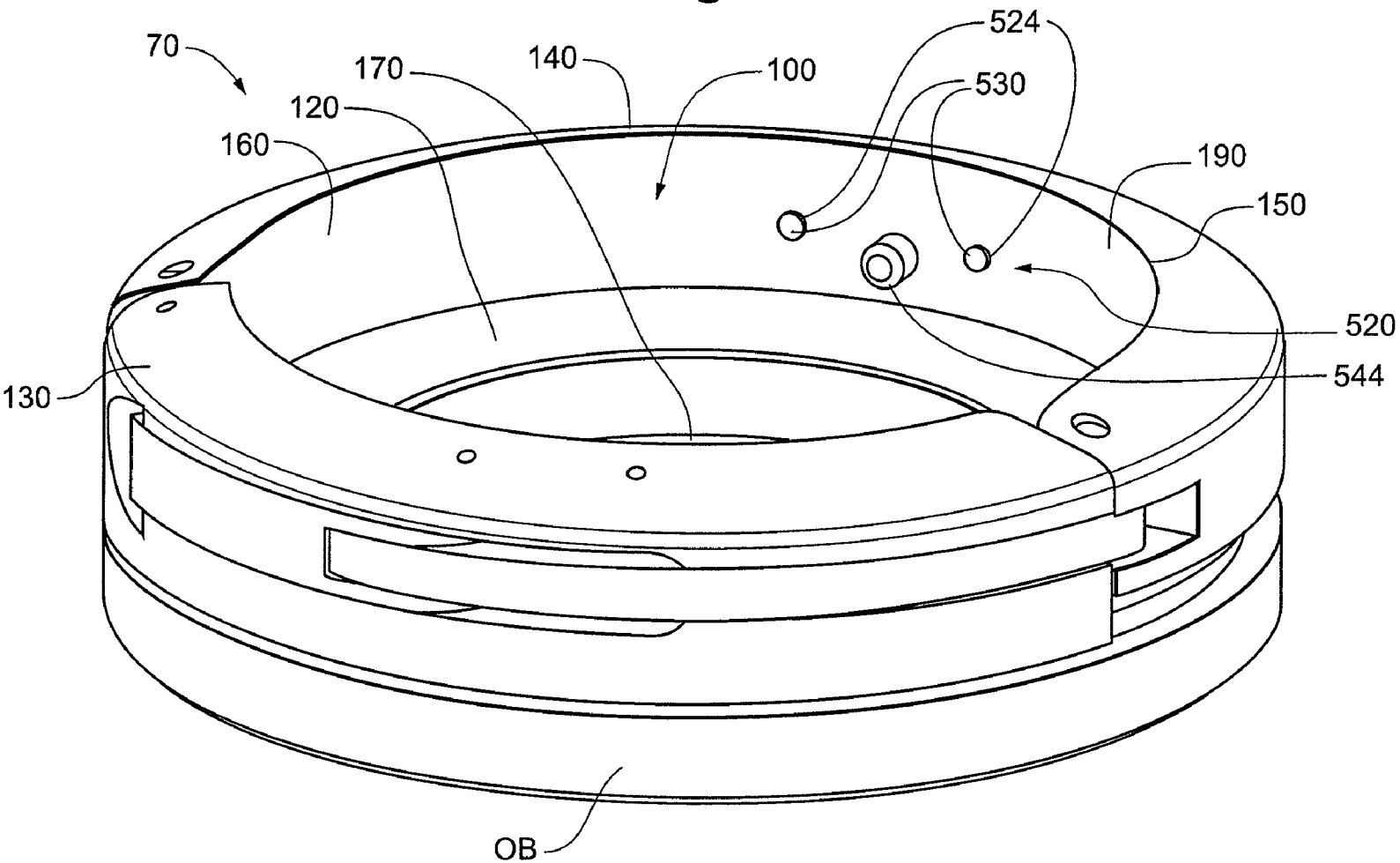
FIG. 21 is a perspective view of a die holder with a die-release mechanism in accordance with an embodiment of the invention.

In the embodiment shown in FIG. 21, the die-release mechanism 520 includes a body 524 having a contact portion 530 that is constantly biased to act against a die mounted on the die holder. Here, the body 524 (or at least its contact portion 530) is under a constant spring bias, regardless of whether the die holder 70 is in a closed and/or clamped configuration or an open and/or unclamped configuration. In such embodiments, the body 524 can advantageously be mounted movably on the die holder's wall portion 140. Preferably, the body 524 is mounted in an opening (e.g., a bore) extending into the wall portion 140 and opening through interior surface 190. A resilient member, such as a spring (not shown in FIG. 21), can be used to constantly bias the body 524 in the desired direction (optionally toward a side of the die holder that is adapted to open). In FIG. 21, the die-release mechanism 520 comprises two such bodies 524, although one, three, or any other desired number can be used. In some of the present embodiments, the body 524 is adapted to move horizontally during actuation of the die-release mechanism (e.g., if the die holder is mounted on a table of a press).

In some embodiments, the body 524 is adapted to move radially (e.g., at least generally radially, or at least substantially radially) and/or at least generally toward a central axis CA of the interior recess so as to apply a separation force on the die 90, and the body 524 is resiliently biased toward (generally toward, substantially toward, or directly toward) the central axis CA of the interior recess. In such an embodiment, when a die 90 is moved into the die holder 70 and the die holder is moved into its closed configuration, the die 90 will exert sufficient force on the body 524 to retract the body 524 (overcoming the biasing force) into the die holder's wall portion. When the die holder 70 is placed in the open configuration, the body 524 will have sufficient biasing force (e.g., enough spring force) to overcome stiction and move the die 90 (e.g., so as to separate the die from at least one die holder surface to which the die was originally stuck due to the stiction).

Figure 22:
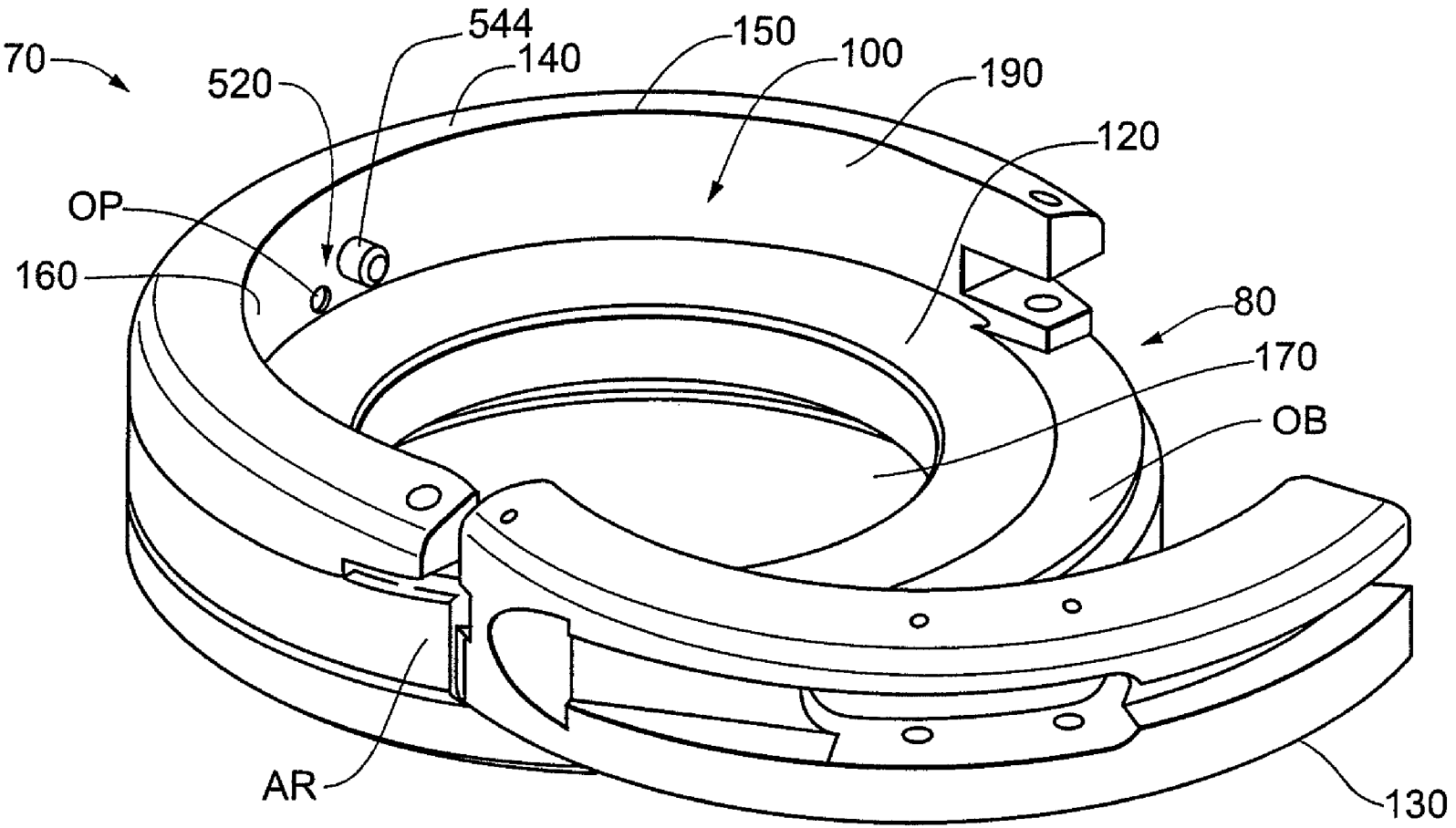
FIG. 22 is a perspective view of a die holder with a die-release mechanism in accordance with another embodiment of the invention.
Figure 23:
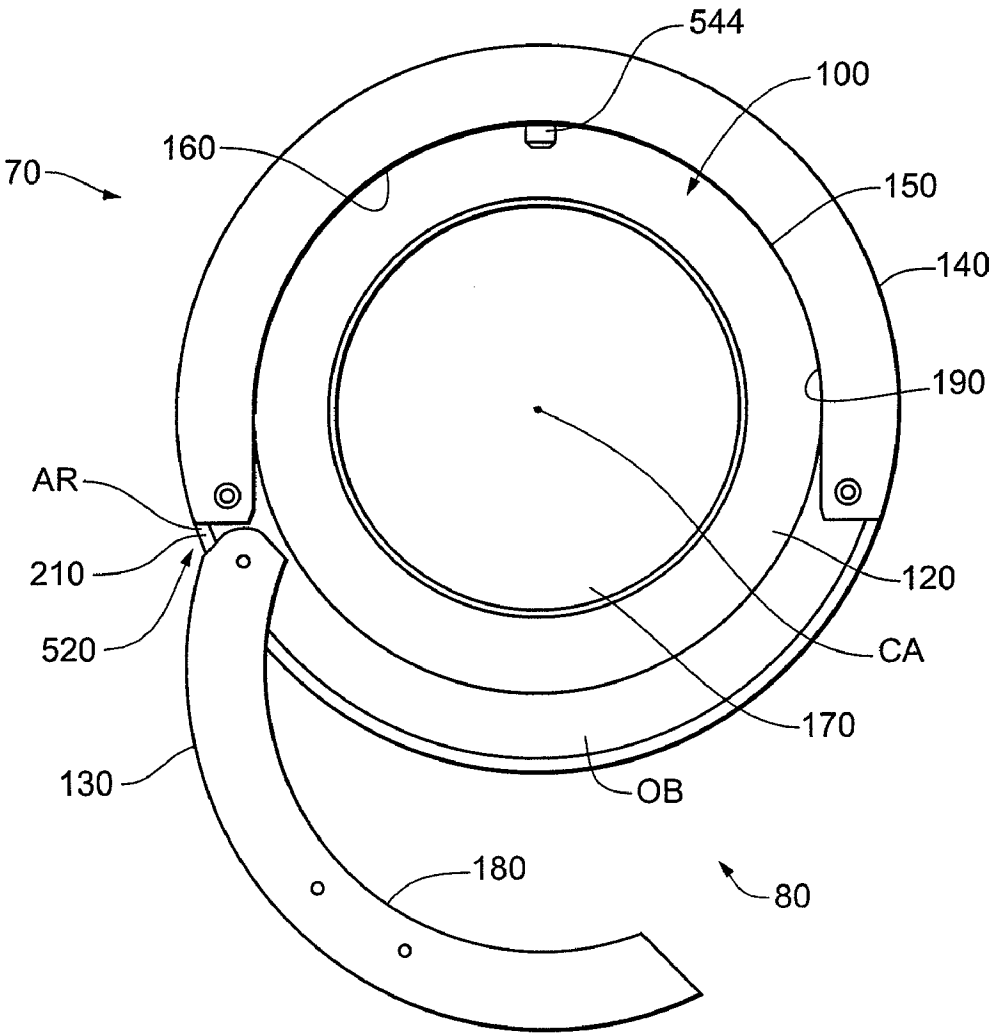
FIG. 23 is a top plan view of the die holder of FIG. 22.

In the embodiment of FIGS. 22 and 23, the die-release mechanism 520 is adapted to actuate in response to the die holder 70 being moved from its closed configuration to its open configuration. In the embodiment of FIGS. 22 and 23, the clamp portion 130 is hingedly connected to the wall portion 140. As the clamp portion 130 pivots open relative to the wall portion 140, an actuating ring AR moves circumferentially on (e.g., within) the wall portion 140. Preferably, the actuating ring has a cam 540 that cams with the body 524 defining the contact portion 530, thereby forcing the body 524 and its contact portion 530 to move (optionally radially and/or at least generally toward a central axis of the interior recess) so as to apply a separation force on a die mounted on the die holder.

Thus, in some embodiments, at least a portion of the actuator (e.g., an actuating ring AR thereof) moves along a curved path during actuation of the die-release mechanism.

With continued reference to FIGS. 22 and 23, when the illustrated die holder is in the closed configuration, the actuator ring AR is positioned such that the cam 540 does not force the body 524 to bear forcibly against a die mounted on the die holder (e.g., at such times, the illustrated body 524 is free to retract fully inside an opening OP in the die holder's wall portion). If desired, the die holder can include a spring (not shown) biased to return the body 524 (e.g., to its fully retracted position) and/or the actuating ring when the die holder 70 is moved from its open configuration to its closed configuration. In other embodiments, simply placing a die within the die holder 70 will cause the body 524 to retract into the die holder's wall portion. The present embodiment is useful for allowing selective actuation of the die-release mechanism.

One or more keys 544 (e.g., useful for aligning the die within the die holder) can optionally be provided in any embodiment described in the present disclosure. The key can optionally be rigidly fixed to the wall portion, and can be a pin or any other key structure.

Figure 24:
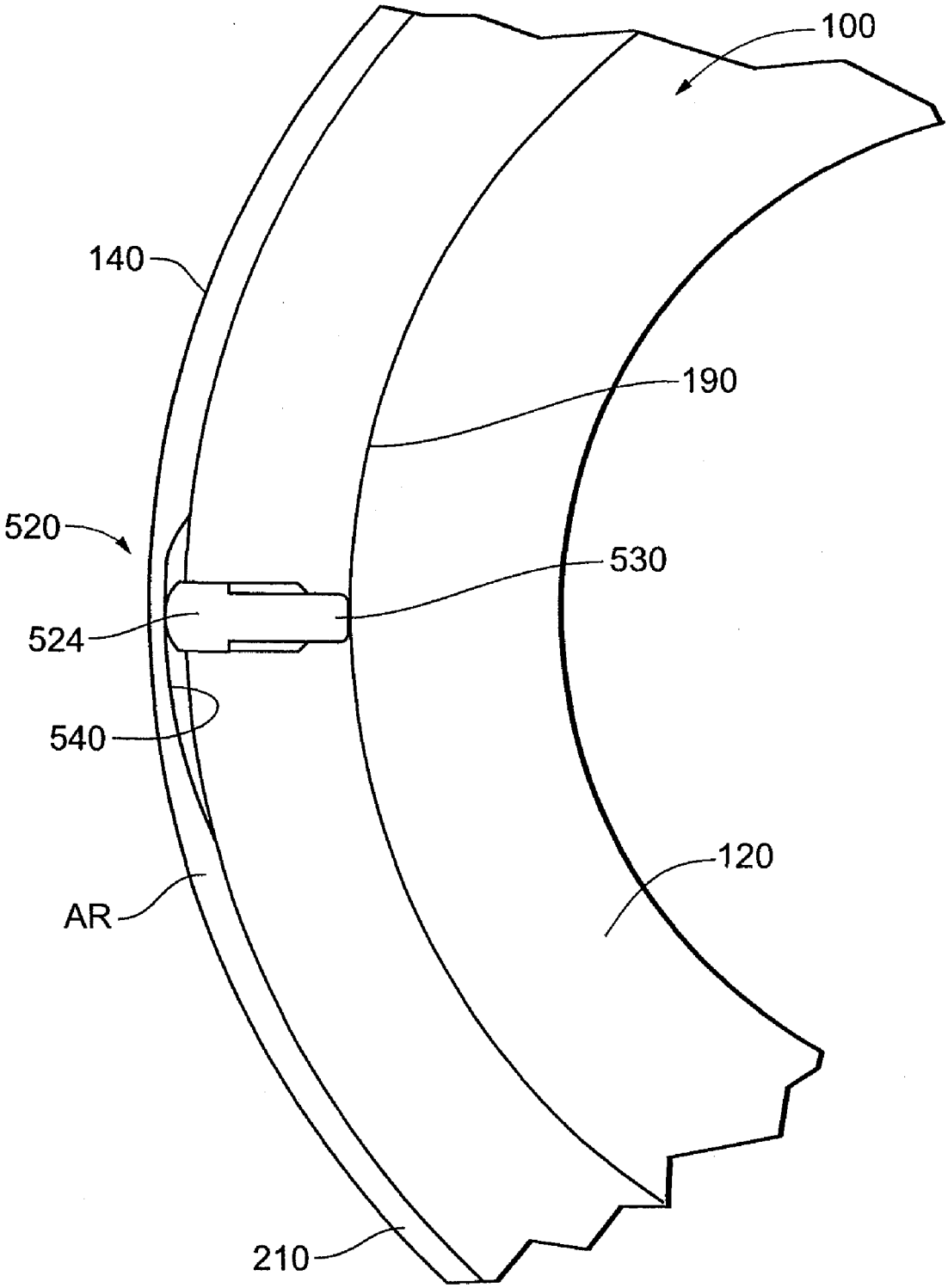
FIG. 24 is a schematic, broken-away top plan view of a portion of a die holder having a die-release mechanism in accordance with certain embodiments of the invention.
Figure 25:
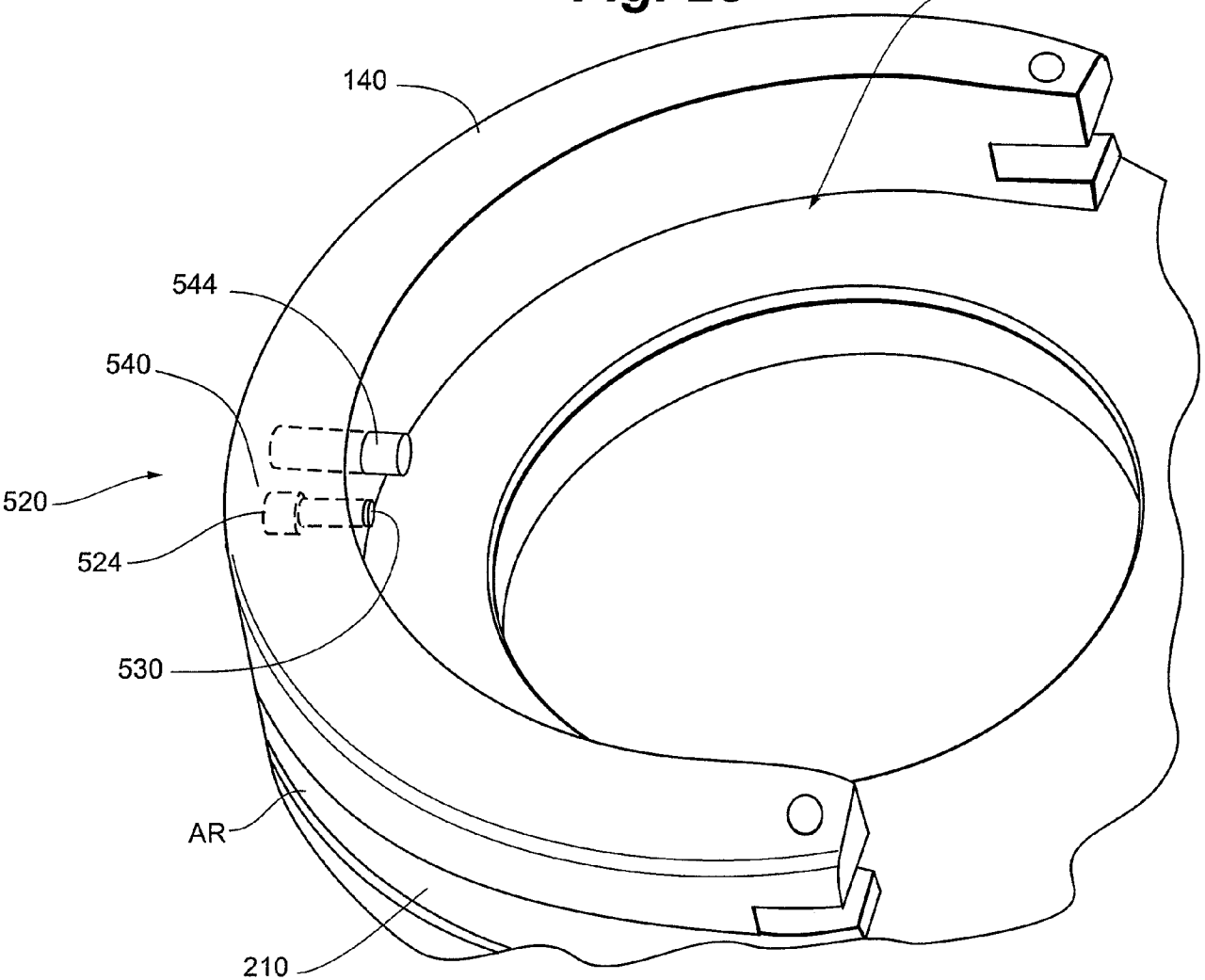
FIG. 25 is a broken-away hidden line perspective view of a die holder having a die-release mechanism in accordance with certain embodiments of the invention.
Figure 29:
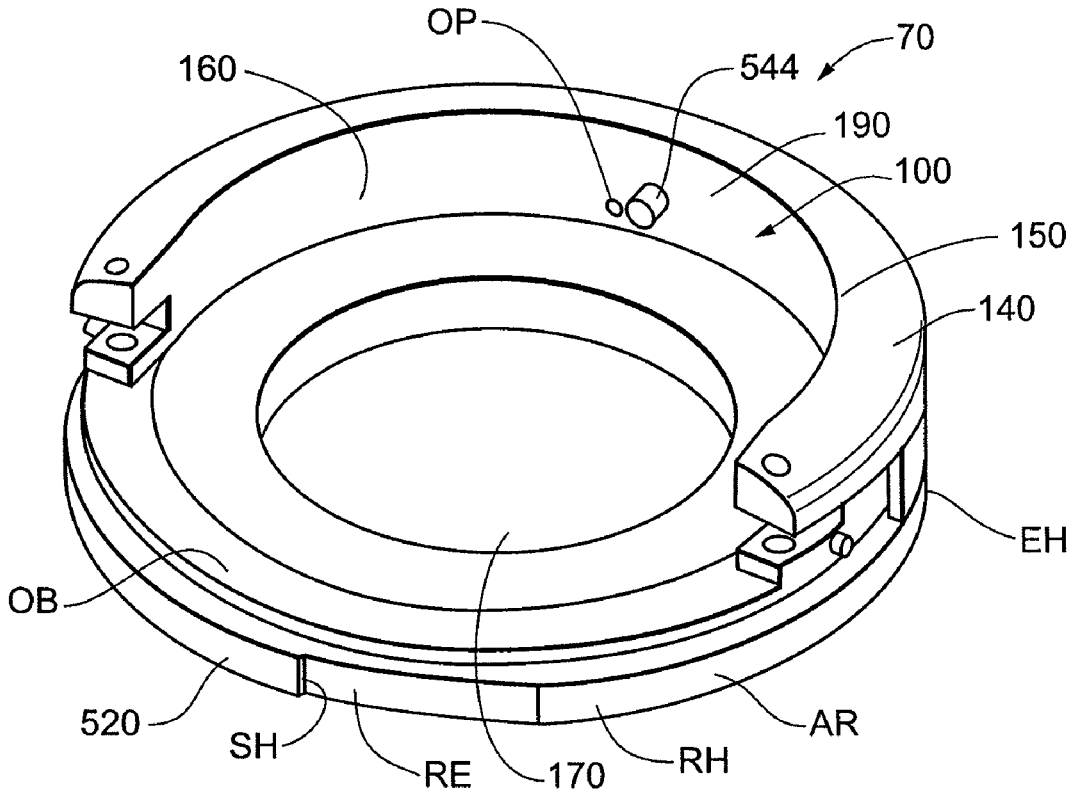
FIG. 29 is a perspective view of a die holder in a disassembled configuration in accordance with certain embodiments of the invention.

An actuating ring AR like that shown in FIG. 24 may or may not rotate in response to a clamp portion 130 of the die holder being moved to its open position. FIG. 29 shows an actuator comprising an actuating ring AR with a reduced-height portion RH and an enlarged height portion EH. This type of actuator ring AR is also shown in FIG. 25. Here, the enlarged height portion EH defines a cam 540 on which a rear end of body 524 cams when the actuating ring is rotated so as to actuate the die-release mechanism. The ring in such camming embodiments need not have the enlarged EH and reduced RH height portions (the ring can have uniform height, etc.). In FIG. 29, the actuating ring AR can be made to rotate by manually pushing a shoulder SH on the ring (alternatively, this can be done hydraulically, pneumatically, etc.). The actuating ring AR in this embodiment can optionally extend entirely about a perimeter of the die holder (and/or it can optionally be configured to entirely encompass the interior recess). Alternatively, it may extend only partway about the perimeter (optionally encompassing at least 25°, 30°, 45°, 90°, 180°, 270°, or 300°). Preferably, rotating the actuating ring AR in a desired direction causes a body 524 of the die-release mechanism to move forcefully (e.g., so as to apply a positive force) against a die mounted on the die holder. This can be done by camming, as has been described, or by other means. The actuating ring AR may have an annular configuration, as shown. However, this is not required.

Figure 26:
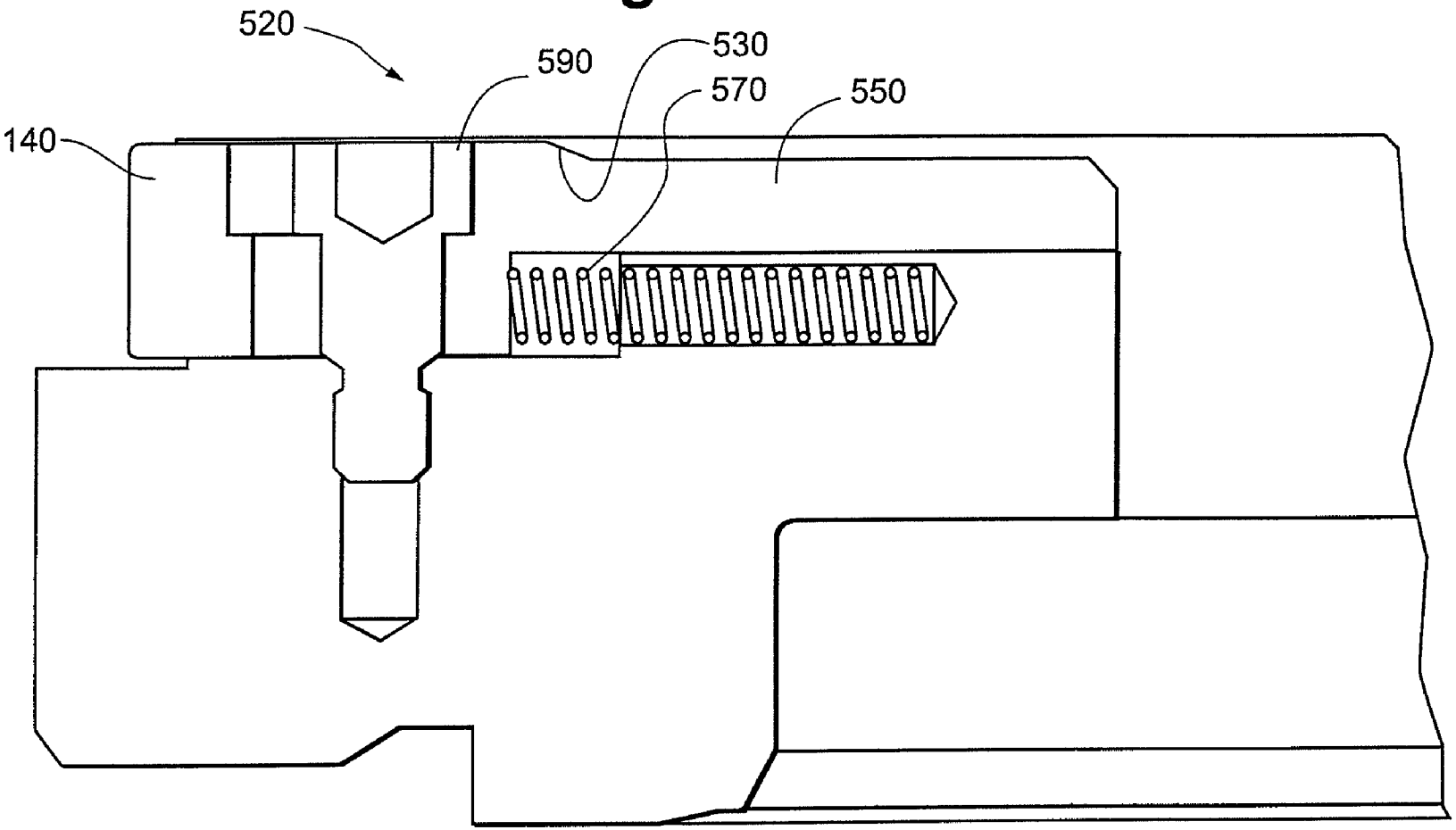
FIG. 26 is a broken-away partial side cut-away view of a die holder with a die-release mechanism in accordance with another embodiment of the invention.
Figure 27:
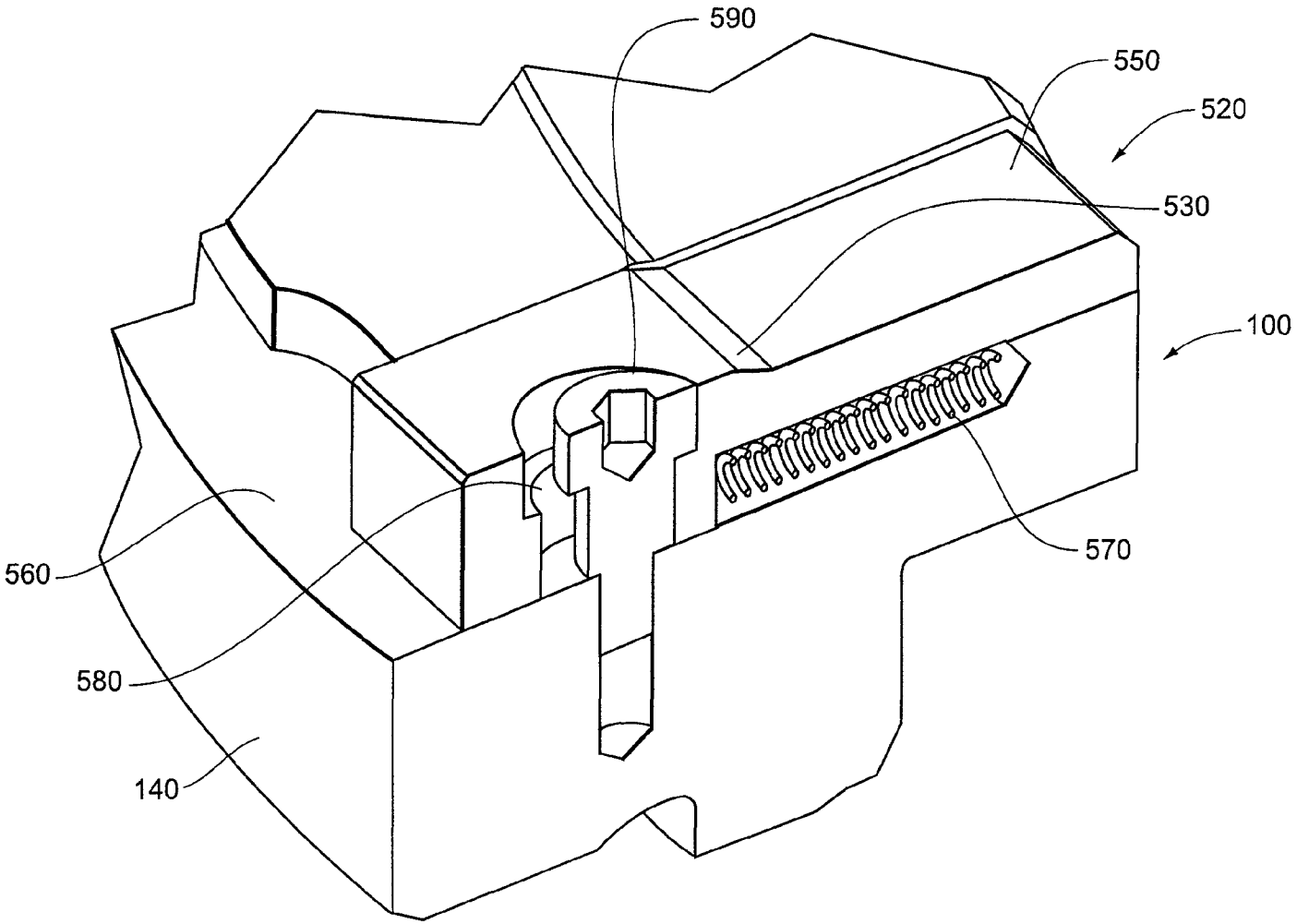
FIG. 27 is a broken-away partial perspective cut-away view of the die holder with the die-release mechanism of FIG. 26 in accordance with an embodiment of the invention.
Figure 28:
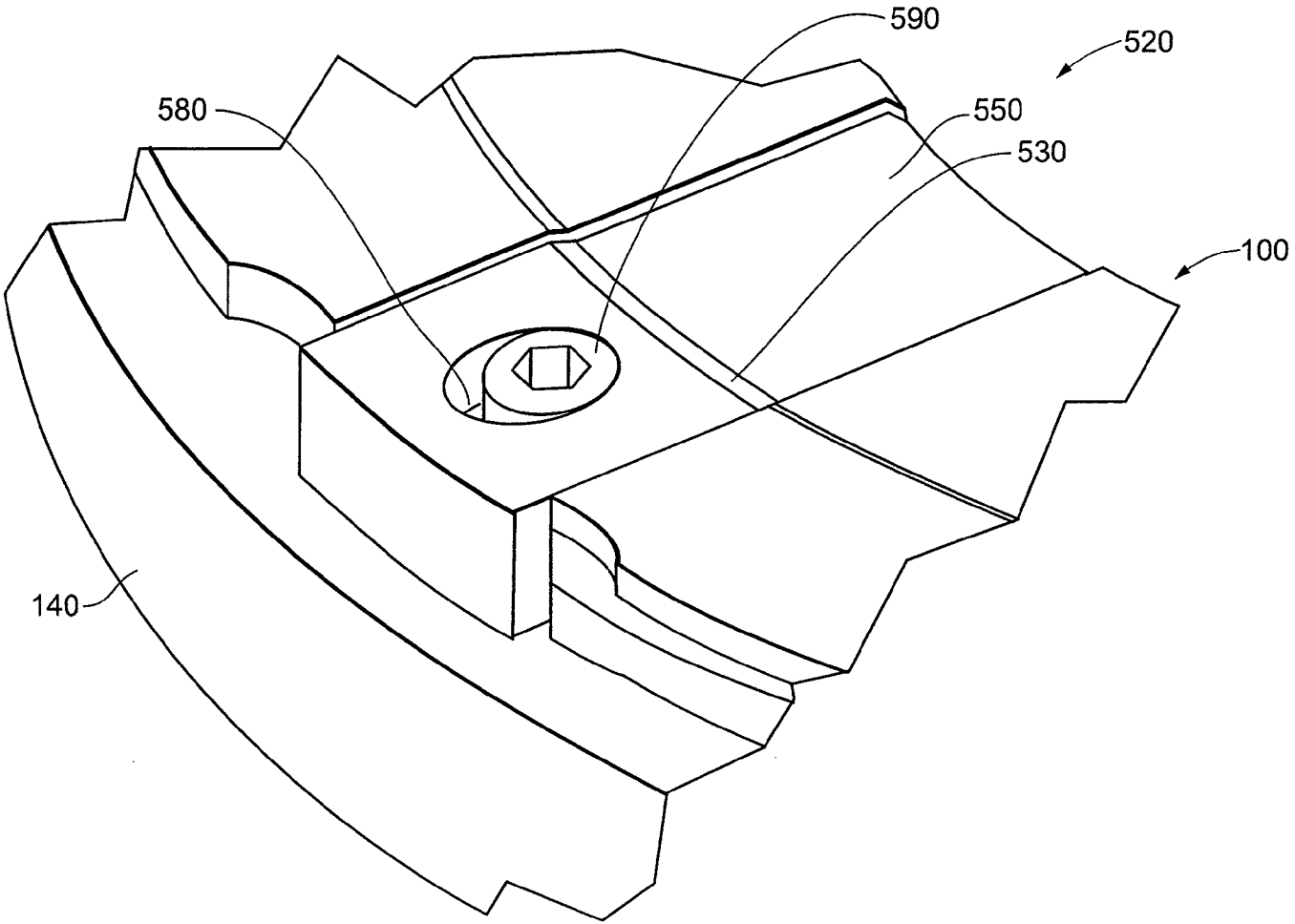
FIG. 28 is a broken-away partial perspective view of the die holder with the die-release mechanism of FIG. 26 in accordance with an embodiment of the invention.

Another embodiment that allows for selective actuation of the die-release mechanism 520 is shown in FIGS. 26-28. When the die 90 is received in the interior recess 100 of the die holder 70, the die-release mechanism 520 can be actuated at a desired time to apply a separation force on the die 90 (e.g., so as to urge the die 90 away from at least a portion of the die holder 70). In the embodiment shown in FIGS. 26-28, the die-release mechanism comprises a wedge member 550 with a contact portion 530, where actuating the die-release mechanism involves the wedge member 550 moving (e.g., at least generally radially) such that the contact portion 530 wedges beneath a die 90 in the die holder's interior recess.

In the embodiment of FIGS. 26-28, the wedge member 550 can optionally be biased away from the die holder's central recess 170 (and/or toward the adjacent outer perimeter of the die holder) by a wedge spring 570. To actuate this die-release mechanism 520, a force can be applied (optionally manually) to move the wedge member 550 toward the central recess 170 and into lifting contact with a die in the interior recess 100. The wedge member 550 can have a slot 580 sized to receive a fastener (e.g., a bolt, peg, etc.) 590 adapted to allow the wedge member 550 to articulate relative to the central recess (e.g., relative to the die holder wall on which it is mounted) without detaching from the die holder 70. In the present embodiment (and in the embodiments of FIGS. 22-25 and 29), the separation force involves a positive, physical push of the die away from at least a portion of the die holder 70. This is contrary to embodiments wherein the die is biased by a spring-loaded body, as the separation force here is a positive force. Embodiments of this nature are particularly desirable for overcoming stiction. Thus, one embodiment group extends to any die holder (e.g., of any design disclosed herein) having a die-release mechanism adapted to apply a positive separation force to a die mounted on the die holder.

In some embodiments, an operator wishing to remove or exchange a die 90 from a metal-fabricating press 10 may do so by first adjusting any of the embodiments of the die holder 70 discussed herein from a clamped to an unclamped configuration and from a closed to an open configuration. The die 90 can then be removed from the die holder 70. Another die 90 can be then be placed within the die holder 70, and the die holder can be adjusted to a closed configuration and a clamped configuration.

In some embodiments, an operator may use a die-release mechanism 520 to overcome stiction in the process of removing a die 90 from the die holder 70. For example, a constantly biased member (e.g., a spring-loaded body) can be provided (and used) to release the die 90 when the die holder 70 is adjusted from the clamped configuration to the unclamped configuration and/or from the closed configuration to the open configuration. Alternatively, a die-release mechanism 520 may be selectively actuated, e.g., in response to an operator moving the die holder 70 from the closed configuration to the open configuration. In certain embodiments, the operator can selectively actuate the die-release mechanism 520 by moving a wedge member 550 so as to cause the wedge member to bear forcibly against the die 90 (optionally, so as to separate a bottom surface of the die from a support surface of the die holder, which may involve the wedge member lifting the die away from the die holder's shelf/support surface).

While a preferred embodiment of the present invention has been described, it should be understood that various changes, adaptations and modifications may be made therein without departing from the spirit of the invention and the scope of the appended claims.

What is claimed is:

1. A die holder for a metal-fabricating press, the die holder defining an interior recess configured to receive a die, the die holder including a clamp portion and a wall portion, wherein the clamp and wall portions are adapted to be positioned in an open configuration or a closed configuration, the clamp and wall portions together surrounding said interior recess when in the closed configuration, wherein the die holder can be adjusted from an unclamped configuration to a clamped configuration by performing a clamping operation, and the die holder can be adjusted from the clamped configuration to the unclamped configuration by performing an unclamping operation, wherein when the die is received in said interior recess and the die holder is in the clamped configuration the die is clamped securely by the die holder, the die holder being provided with a single-motion actuator, such that the die holder is adapted to clamp in response to a single motion of the actuator, and wherein the die holder includes at least one spring component.

2. The die holder of claim 1 wherein the single-motion actuator also is adapted for causing the die holder to unclamp in response to a single motion of the actuator.

3. The die holder of claim 1 wherein, when the clamp and wall portions are positioned in the open configuration, the die can be mounted in the die holder by moving the die sideways through an open side of the die holder, after which the clamp and wall portions can be positioned in the closed configuration and then said clamping operation can be performed to securely clamp the die holder on the die.

4. The die holder of claim 1 wherein the actuator is a tool-free actuator, such that both said clamping and unclamping operations are tool-free operations.

5. The die holder of claim 1 wherein the actuator comprises a body that moves in one direction during said clamping operation and in another direction during said unclamping operation.

6. The die holder of claim 5 wherein said body is a handle or latch that moves pivotally during said clamping and unclamping operations.

7. The die holder of claim 5 wherein said body is a handle, the die holder has a shelf adapted to support a bottom of the die, the shelf having a support surface on which the bottom of the die is adapted to rest, and wherein during said clamping and unclamping operations the handle is moved in a plane that is at least generally parallel to the shelf's support surface.

8. The die holder of claim 7 wherein the die holder is mounted on a horizontal table of the metal-fabricating press, and during said clamping and unclamping operations the handle moves horizontally.

9. The die holder of claim 1 wherein the clamp portion is a concave clamp portion and the wall portion is a concave wall portion, and when the clamp and wall portions are positioned in the closed configuration, the die holder has a generally annular configuration.

10. The die holder of claim 1 wherein the die holder is an independently-operable die holder such that performing said clamping operation clamps the die holder alone and does not simultaneously clamp any other die holder.

11. The die holder of claim 1 wherein said interior recess has a generally circular configuration, the clamp portion has a concave interior surface and the wall portion has a concave interior surface, said interior surfaces being adapted to engage the die when the die holder is clamped securely on the die.

12. The die holder of claim 11 wherein, when the clamp and wall portions are positioned in the closed configuration, the concave interior surface of the clamp portion bounds at least 30 degrees of said interior recess.

13. The die holder of claim 11 wherein, when the clamp and wall portions are positioned in the closed configuration, the concave interior surface of the clamp portion bounds more than 180 degrees of said interior recess.

14. The die holder of claim 1 wherein during said clamping operation the die holder applies a clamping force on the die, and wherein the spring component generates at least part of the clamping force.

15. The die holder of claim 1 wherein the spring component comprises a body formed of spring steel.

16. The die holder of claim 15 wherein the spring steel body forms at least part of the die holder's clamp portion.

17. The die holder of claim 1 wherein the spring component comprises a latch, the latch being hingedly joined to a first of the clamp portion and the wall portion, the latch having a free end that can be hooked onto a second of the clamp portion and the wall portion whereafter the latch can be tightened as part of said clamping operation.

18. The die holder of claim 1 wherein the clamp portion is hingedly joined to the wall portion, such that the clamp and wall portions can be moved between the closed and open configurations by pivoting the clamp portion relative to the wall portion.

19. The die holder of claim 1 wherein said open configuration involves the clamp portion being removed from the wall portion, said closed configuration involves the clamp portion being attached removably to the wall portion, and when the clamp and wall portions are in the closed configuration said clamping operation can be performed to decrease a dimension of said interior recess.

20. The die holder of claim 1 wherein the die holder has a shelf adapted to support a bottom of the die, and the die holder has a shoulder defining an interior side surface that extends at least generally orthogonally from the shelf, the shoulder bounding said interior recess, wherein the die holder has a central opening, and the shelf encompasses said central opening.

21. The die holder of claim 1 wherein the metal-fabricating press is a turret press having a turret with a plurality of stations adapted to receive respective tool holders, the die holder being mounted removably to the turret.

22. The die holder of claim 1 wherein the die holder is mounted removably within an opening defined by a table of the metal-fabricating press.

23. The die holder of claim 1 wherein die holder is adapted for being clamped and unclamped without any assembly or disassembly of the die holder.

24. A die holder for a metal-fabricating press, the die holder defining an interior recess configured to receive a die, the die holder including a clamp portion and a wall portion, wherein the clamp and wall portions are adapted to be positioned in an open configuration or a closed configuration, the clamp and wall portions together surrounding said interior recess when in the closed configuration, wherein the die holder can be adjusted from an unclamped configuration to a clamped configuration by performing a clamping operation, and the die holder can be adjusted from the clamped configuration to the unclamped configuration by performing an unclamping operation, wherein when the die is received in said interior recess and the die holder is in the clamped configuration the die is clamped securely by the die holder, and wherein, when the clamp and wall portions are positioned in the open configuration, the die can be mounted in the die holder by moving the die sideways through an open side of the die holder, after which the clamp and wall portions can be positioned in the closed configuration and then said clamping operation can be performed to securely clamp the die holder on the die, the die holder being provided with an actuator comprising a pivotable body that moves pivotally during said clamping and unclamping operations, and wherein the die holder includes at least one spring component.

25. The die holder of claim 24 wherein said pivotable body pivots about a hinge during said clamping and unclamping operations.

26. The die holder of claim 24 wherein the actuator is a tool-free actuator such that both said clamping and unclamping operations are tool-free operations.

27. The die holder of claim 24 wherein the die holder is provided with a single-motion actuator, such that the die holder clamps in response to a single motion of the actuator.

28. The die holder of claim 24 wherein the die holder has a shelf adapted to support a bottom of the die, the shelf having a support surface on which the bottom of the die is adapted to rest, and wherein during said clamping and unclamping operations said pivotable body moves pivotally along a plane that is either substantially parallel or substantially perpendicular to the shelf's support surface.

29. The die holder of claim 24 wherein said pivotable body is a handle, the die holder is on a horizontal table of the metal-fabricating press, and during said clamping and unclamping operations the handle moves horizontally.

30. The die holder of claim 24 wherein said interior recess has a generally circular configuration, the clamp portion has a concave interior surface and the wall portion has a concave interior surface, said interior surfaces being adapted to engage the die when the die holder is clamped securely on the die, and wherein, when the clamp and wall portions are positioned in the closed configuration, the interior surface of the clamp portion bounds at least 30 degrees of said interior recess.

31. The die holder of claim 24 wherein during said clamping operation the die holder applies a clamping force on the die, wherein the spring component generates at least part of the clamping force, the spring component comprising a body formed of spring steel.

32. The die holder of claim 24 wherein the die holder is an independently-operable die holder such that performing said clamping operation clamps the die holder alone and does not simultaneously clamp any other die holder.

33. A die holder for a metal-fabricating press, the die holder defining an interior recess configured to receive a die, the die holder including a clamp portion and a wall portion, wherein the clamp and wall portions are adapted to be positioned in an open configuration or a closed configuration, the clamp and wall portions together surrounding said interior recess when in the closed configuration, wherein the die holder can be adjusted from an unclamped configuration to a clamped configuration by performing a clamping operation, and the die holder can be adjusted from the clamped configuration to the unclamped configuration by performing an unclamping operation, wherein when the die is received in said interior recess and the die holder is in the clamped configuration the die is clamped securely by the die holder, and wherein, when the clamp and wall portions are positioned in the open configuration, the die can be mounted in the die holder by moving the die sideways through an open side of the die holder, after which the clamp and wall portions can be positioned in the closed configuration and said clamping operation can be performed to securely clamp the die holder on the die, the die holder being provided with an actuator comprising a pivotable body that moves pivotally during said clamping and unclamping operations, and wherein the metal-fabricating press is a turret press having a turret with a plurality of stations adapted to receive respective tool holders, the die holder being mounted removably to the turret.

34. A metal-fabricating press and a die holder in combination, the metal-fabricating press having upper and lower tables separated by a gap, the gap being adapted to receive a sheet-like workpiece, the die holder being removably mounted on the lower table, the die holder defining an interior recess configured to receive a die, the die holder including a clamp portion and a wall portion, wherein the clamp and wall portions are adapted to be positioned in an open configuration or a closed configuration, the clamp and wall portions together surrounding said interior recess when in the closed configuration, wherein the die holder can be adjusted from an unclamped configuration to a clamped configuration by performing a clamping operation, and the die holder can be adjusted from the clamped configuration to the unclamped configuration by performing an unclamping operation, wherein when the die is received in said interior recess and the die holder is in the clamped configuration the die is clamped securely by the die holder, and wherein, when the clamp and wall portions are positioned in the open configuration, the die can be moved into the gap and mounted in the die holder by moving the die sideways through an open side of the die holder, after which the clamp and wall portions can be positioned in the closed configuration and said clamping operation can be performed to securely clamp the die holder on the die, the die holder being provided with an actuator comprising a moveable body that pivots about at least one hinge during said clamping and unclamping operations, and wherein the gap is a generally horizontal gap, and said moveable body comprises a latch that moves vertically during said clamping and unclamping operations.

35. The press and die holder combination of claim 34 wherein, when the clamp and wall portions of the die holder are positioned in the open configuration, said open side of the die holder faces an exterior perimeter of the press.

36. The press and die holder combination of claim 34 wherein the actuator is a single-motion actuator, such that the die holder clamps in response to a single motion of the actuator.

37. The press and die holder combination of claim 34 wherein the actuator is a tool-free actuator such that said clamping and unclamping operations are tool-free operations.

38. The press and die holder combination of claim 34 wherein the gap is a generally horizontal gap, and said moveable body comprises a handle that moves at least generally horizontally during said clamping and unclamping operations.

39. A tool-free die holder for a metal-fabricating press, the die holder defining an interior recess configured to receive a die, the die holder including a clamp portion and a wall portion, wherein the clamp and wall portions are adapted to be positioned in an open configuration or a closed configuration, the clamp and wall portions together surrounding said interior recess when in the closed configuration, wherein the die holder can be adjusted from an unclamped configuration to a clamped configuration by performing a clamping operation, and the die holder can be adjusted from the clamped configuration to the unclamped configuration by performing an unclamping operation, wherein when the die is received in said interior recess and the die holder is in the clamped configuration the die is clamped securely by the die holder, the die holder being provided with a tool-free actuator, such that both said clamping and unclamping operations are tool-free operations, and wherein said open configuration involves the clamp portion being removed from the wall portion, and said closed configuration involves the clamp portion being attached removably to the wall portion.

40. The die holder of claim 39 wherein, when the clamp and wall portions are positioned in the open configuration, the die can be mounted in the die holder by moving the die sideways through an open side of the die holder.

41. The die holder of claim 39 wherein the actuator is a single-motion actuator that allows the unclamping operation to be performed in response to a single motion of the actuator.

42. The die holder of claim 41 wherein the actuator comprises a body that moves pivotally during the unclamping operation.

43. The die holder of claim 39 wherein the clamp portion is a concave clamp portion and the wall portion is a concave wall portion, and when the clamp and wall portions are positioned in the closed configuration the die holder has a generally annular configuration.

44. The die holder of claim 39 wherein the die holder is an independently-operable die holder such that performing the unclamping operation unclamps the die holder alone and does not simultaneously unclamp any other die holder.

45. The die holder of claim 39 wherein said interior recess has a generally circular configuration, the clamp portion has a concave interior surface and the wall portion has a concave interior surface, said interior surfaces being adapted to engage the die when the die holder is clamped securely on the die.

46. The die holder of claim 45 wherein, when the clamp and wall portions are positioned in the closed configuration, the concave interior surface of the clamp portion bounds at least 30 degrees of said interior recess.

47. The die holder of claim 46 wherein, when the clamp and wall portions are positioned in the closed configuration, the concave interior surface of the clamp portion bounds more than 180 degrees of said interior recess.

48. The die holder of claim 39 wherein the die holder has a shelf adapted to support a bottom of the die, and the die holder has a shoulder defining an interior side surface that extends at least generally orthogonally from the shelf, the shoulder bounding said interior recess, wherein the die holder has a central opening, and the shelf encompasses said central opening.

49. The die holder of claim 39 wherein the die holder can be adjusted from the unclamped configuration to the clamped configuration by performing a clamping operation, and wherein the single-motion actuator allows the clamping operation to be performed in response to a single motion of the actuator.

50. The die holder of claim 49 wherein the actuator comprises a body that moves in one direction during the clamping operation and in another direction during the unclamping operation.

51. The die holder of claim 39 wherein the die holder is mounted removably within an opening defined by a table of the fabricating press.

52. The die holder of claim 39 wherein die holder is adapted for being clamped and unclamped without any assembly or disassembly of the die holder.

53. The die holder of claim 39 wherein, when the die holder is in the unclamped, open configuration, the die holder has an open side.

54. A tool-free die holder for a metal-fabricating press, the die holder defining an interior recess configured to receive a die, the die holder including a clamp portion and a wall portion, wherein the clamp and wall portions are adapted to be positioned in an open configuration or a closed configuration, the clamp and wall portions together surrounding said interior recess when in the closed configuration, wherein the die holder can be adjusted from an unclamped configuration to a clamped configuration by performing a clamping operation, and the die holder can be adjusted from the clamped configuration to the unclamped configuration by performing an unclamping operation, wherein when the die is received in said interior recess and the die holder is in the clamped configuration the die is clamped securely by the die holder, the die holder being provided with a tool-free actuator, such that both said clamping and unclamping operations are tool-free operations, and wherein the die holder includes at least one spring component.

55. The die holder of claim 54 wherein during a clamping operation the die holder applies a clamping force on the die, and wherein the spring component generates at least part of the clamping force.

56. The die holder of claim 54 wherein the spring component comprises a body formed of spring steel, and the spring steel body forms at least part of the die holder's clamp portion.

57. A tool-free die holder for a metal-fabricating press, the die holder defining an interior recess configured to receive a die, the die holder including a clamp portion and a wall portion, wherein the clamp and wall portions are adapted to be positioned in an open configuration or a closed configuration, the clamp and wall portions together surrounding said interior recess when in the closed configuration, wherein the die holder can be adjusted from an unclamped configuration to a clamped configuration by performing a clamping operation, and the die holder can be adjusted from the clamped configuration to the unclamped configuration by performing an unclamping operation, wherein when the die is received in said interior recess and the die holder is in the clamped configuration the die is clamped securely by the die holder, the die holder being provided with a tool-free actuator, such that both said clamping and unclamping operations are tool-free operations, and wherein the fabricating press is a turret press having a turret with a plurality of stations adapted to receive respective tool holders, the die holder being mounted removably to the turret.

* * * * *